US011549414B1

(12) United States Patent
Adams

(10) Patent No.: US 11,549,414 B1
(45) Date of Patent: Jan. 10, 2023

(54) SOUND ATTENUATOR APPARATUS AND METHOD

(71) Applicant: Phillip M. Adams, Afton, WY (US)

(72) Inventor: Phillip M. Adams, Afton, WY (US)

( * ) Notice: Subject to any disclaimer, the term of this patent is extended or adjusted under 35 U.S.C. 154(b) by 251 days.

(21) Appl. No.: 16/677,405

(22) Filed: Nov. 7, 2019

(51) Int. Cl.
*F01N 1/08* (2006.01)
*F01N 1/00* (2006.01)

(52) U.S. Cl.
CPC ..... *F01N 1/08* (2013.01)

(58) Field of Classification Search
CPC ..... F01N 1/08; F01N 1/12; F01N 1/06; F01N 13/04; F01N 2470/14; F01N 2470/20
See application file for complete search history.

(56) References Cited

U.S. PATENT DOCUMENTS 1,482,805 A 2/1924 Maxim
1,756,916 A 4/1930 Stranahan
1,903,803 A * 4/1933 Barker ..... B01D 53/944 502/324
2,995,200 A 8/1961 Seifert
3,447,630 A * 6/1969 Davidson ..... F01N 1/08 181/239
3,580,357 A * 5/1971 Whitney ..... F01N 1/06 181/227
3,612,212 A * 10/1971 Macdonald ..... F02K 1/40 181/175
3,630,311 A * 12/1971 Nagamatsu ..... F02K 1/40 181/213
3,700,069 A * 10/1972 Rausch ..... F01N 1/06 181/227
3,948,348 A * 4/1976 Bychinsky ..... F01N 1/06 181/206
3,948,349 A * 4/1976 Bychinsky ..... F01N 1/06 181/206

(Continued)

FOREIGN PATENT DOCUMENTS

DE 4024803 A1 * 2/1992 ..... F01N 3/2882
DE 4217632 A1 * 5/1993 ..... F01N 13/082

(Continued)

OTHER PUBLICATIONS https://www.fastcompany.com/90316833/scientists-have-discovered-a-shape-that-blocks-all-sound-even-your-coworkers?partner=rss&utm_medium=feed&utm_campaign=rss+fastcompany&utm_content=rss?cid=search, Mar. 11, 2019.

(Continued)

*Primary Examiner* — Edgardo San Martin
(74) *Attorney, Agent, or Firm* — Pate Baird, PLLC

(57) ABSTRACT

Sound waves of an amplitude having a waveform (first value as a function of time and a first maximum) pass into a manifold, which subdivides flow and sound into multiple paths of differing length, yielding transit times offsetting the arrival of each instance of the waveform at an outlet or exit. This minimizes the addition of energy (sound volume, amplitude) arriving at the exit or terminus from each path. Amplitude is thereby reduced (although the waveform shape remains), repeated and offset by the transit time delays of paths discharging at the terminus. One may select the number of paths based on a desired reduction in the sound amplitude. That number is approximately inversely proportional to the ratio of the reduction. For example, six unique paths in an experiment reduced original amplitude (sound volume) to a sixth at an exit.

20 Claims, 20 Drawing Sheets

(56) References Cited

U.S. PATENT DOCUMENTS

| | | | | |
|---|---|---|---|---|
| 4,192,403 | A | 3/1980 | Nakagawa et al. | |
| 4,574,914 | A | 3/1986 | Flugger | |
| 4,880,078 | A | 11/1989 | Inoue et al. | |
| 5,033,581 | A * | 7/1991 | Feuling | F01N 1/06 181/257 |
| 5,164,535 | A | 11/1992 | Leasure | |
| 5,198,625 | A | 3/1993 | Borla | |
| 6,354,398 | B1 | 3/2002 | Angelo et al. | |
| 6,629,580 | B2 | 10/2003 | Nilsson et al. | |
| 6,633,646 | B1 * | 10/2003 | Hwang | G10K 11/175 381/71.5 |
| 7,117,973 | B2 * | 10/2006 | Graefenstein | F02M 35/1227 181/253 |
| 7,380,635 | B2 * | 6/2008 | Harris | F01N 1/06 181/206 |
| 7,412,917 | B2 | 8/2008 | Vais | |
| 7,571,789 | B2 | 8/2009 | Gilli | |
| 9,024,160 | B2 | 5/2015 | Suenaga | |
| 9,238,205 | B2 | 1/2016 | Jebasinski | |
| 9,500,108 | B2 * | 11/2016 | Brown | F01N 1/085 |
| 9,638,087 | B2 * | 5/2017 | Kim | F01N 1/00 |
| 10,196,948 | B2 | 2/2019 | Masui et al. | |
| 10,419,846 | B2 * | 9/2019 | Hayes | G10K 11/22 |
| 2021/0293173 | A1 * | 9/2021 | Hugh | F01N 1/00 |

FOREIGN PATENT DOCUMENTS

| | | | | |
|---|---|---|---|---|
| DE | 4213726 | A1 * | 10/1993 | F01N 1/06 |
| DE | 19500781 | A1 * | 8/1995 | F01N 1/00 |
| DE | 19631431 | A1 * | 4/1997 | F16L 55/02736 |
| DE | 10328144 | A1 * | 1/2005 | F16L 55/033 |
| DE | 102011055266 | A1 * | 5/2013 | F01N 13/04 |
| FR | 2610988 | A1 * | 8/1988 | F01N 13/08 |
| WO | WO-9958824 | A1 * | 11/1999 | F01N 1/06 |

OTHER PUBLICATIONS https://www.amazon.com/VIVOSUN-Noise-Reducer-Silencer-Inline/dp/B01CTM0H1S/ref=sr_1_1?keywords=vivosun+4+inch+noise+reducer+silencer+for+inline+duct+fan&qid=1580834890&sr=8-1, Jan. 31, 2019.

Justin T. Westbrook, Jalopnik Drive Free or Die Mazda Patents Ultra-Compact Exhaust to Make Its New Inline-Six Fit in More Cars https://jalopnik.com/mazda-patents-ultra-compact-exhaust-to-make-its-new-inl-1841470896, Feb. 5, 2020.

* cited by examiner

SOUND ATTENUATOR APPARATUS AND METHOD

BACKGROUND

1. Field of the Invention

This invention relates to sound remediation from point sources such as internal combustion engines and, more particularly, to novel systems and methods for reducing maximum amplitude of sound output from sound attenuators receiving exhausted gases therefrom.

2. Background Art

Noise can be a problem. Background noise interferes with personal communication. Noise is even characterized as a pollutant in public places. Noise in work places and other locations may damage hearing if sufficiently loud or sustained.

Sources of noise are many. Vehicles are a primary source of outdoor noise, and sound attenuator technology is difficult to characterize as a technology. Random arrangements of routes through a sound attenuator have been postulated for over a century with little recognizable definition or process for designing a sound attenuator to reduce sound output from a sound source.

For example, "glass packs" sought to attenuate noise by passing it through a tube surrounded by a bed of fibers. Certain "state of the art" devices currently advertised are hardly more. Various other sound attenuators divide the flow of an exhaust stream and then send those flows back against each other to "cancel" the noise. Resonance in sound attenuators subjected to changes in direction of incoming sound waves, often defeats any if not all concepts for reduction of the noise output. A tuned sound attenuator will still fail, even resonate louder, when engine speed and resulting frequencies change.

Thus, Applicant does not find in literature, products, or patents any clear principles, processes or prediction methods for designing a sound attenuator. It would be an advance to specify "a-priori" and verify an achievable result of reducing amplitude of an attenuated sound below some required threshold value. It would be an advance in the art to find a mechanism, a design process, and a manufacturing process for predictably reducing sound from a source through a sound attenuator design and manufacturing process.

BRIEF SUMMARY OF THE INVENTION

Portions of the disclosure of this patent application contain material that is subject to copyright protection. The copyright owner authorizes reproduction of this patent application (including all text, drawings, and data, in physical or digital form), and any patent issuing thereon, each in their entirety only, and only as they appear in the records of the U.S. Patent and Trademark Office, but otherwise reserves all copyright rights whatsoever. All other copying in any form is expressly prohibited.

In view of the foregoing, in accordance with the invention as embodied and broadly described herein, a method and apparatus are disclosed in embodiments of the present invention as including an array or system of channels that will subdivide and carry the exhaust flow from a sound source. It divides not only the flow but subdivides the energy of the sound into multiple paths, channels, routes between an input location such as a plenum, and an output location such as an exit plenum or the environment directly.

In selected embodiments, the system may be configured to include the plenums in, out, or both with an array or set of multiple paths. Likewise, one may think of the system either as the array itself of paths, as the array of paths along with an input feed plenum, output receiving plenum or both, or even as all of the foregoing and the sound source. Sources of sound may be vehicles, combustion engines in general, gas generating devices, or the like.

A significant and beneficial feature of multiple paths is the creation of a path shape and a unique effective length of each path within a set. Thus, in a system, each path may be designed with its own unique length engineered to create a corresponding unique time of passage (transit time) through that path. Thus, multiple paths, each having a unique length and therefore a unique time of passage therethrough will distribute sound energy over a larger span of time than its origin by offsetting from each other the "sets of sound waves" emanating from a terminal end of each individual path. This has been demonstrated even though all paths receive as input the same set of sound waves (e.g., waveform at an initial end).

By so configuring the paths to each be unique in length and time of passage, each typically of the same cross-sectional area throughout, sound bursts (sets of sound waves; waveforms) are each introduced from their path into a terminal (exit) plenum or directly into the environment at different arrival times. Arrival times are offset from one another by the differences in transit time (proportional to path length) of passage. Thus, the sound energy has been divided among the paths, at the input plenum, which paths are then recombined to discharge a distributed series of sound wave energy each offset in time from others as it arrives alone and in turn at the exit or plenum.

Various configurations for creating a sound attenuator system with multiple unique paths have been developed. Prototypes have been tested, demonstrating the effectiveness in reducing a maximum amplitude of sound generated from a source after it has passed through a system in accordance with the invention. Moreover, it is clear that artifacts or waveforms (shapes) of the input signal or input sound waves are found repeated at reduced amplitude in the exit sound. Each residual artifact is offset according to its transit time (defined by its transit path length) through its corresponding pathway.

Likewise, the maximum amplitude of sound output is reduced. The energy is divided and distributed over time. For several embodiments, the separation of that sound energy has been proven effective in experiments.

Among the various configurations are comparatively thin panels walled in on each side. Passages are each shaped as a calculable function, such as a trigonometric function, to array and pass through between those outer wall panels (sheets, plates). Such a configuration may be designed with sheet metal side panels and sheet metal walls, perpendicular thereto, bounding each path. In prototypes, such were machined out of a solid metal base plate. Such prototypes tend to waste material and mass limits if simply machined from solid metal.

In other embodiments, tubular paths may be coiled around one another, each increasing in length according to its radius from some central axis of symmetry. Thus, a center tube extending straight along that axis will have a comparatively short length. A tube wrapped around the center tube will then have a longer length characterized by the number of turns and the radius at which each of those turns is made. Lengths of subsequent coils of tubing will each increase in accordance with their individual radius of curvature, even without altering the number of turns.

Similarly, channels may be fabricated as a series of walls creating barriers at various radii, with internal walls between the structural, cylindrical walls, spiraling down. All may spiral at the same rate of pitch (advanced per revolution) or may have different pitches. Each cylindrical shell between paths will necessarily have a different radius. All may have the same pitch and the same number of turns and yet have different delay times (transit times) through their path lengths. Nevertheless, if pitches change, even more difference in comparative passage lengths may be created.

By the same token, passageways may instead be formed as if they were multi-start threads or flutes. This may be done to control cross-sectional area or to prevent "bypassing" by flows or sounds. For example, all passages may start in the same plane and at the same radius. The passages may be bounded by an inner wall and an outer wall characterized as right circular cylinders. The individual passageways may be characterized as ramps. These ramps may be allowed to spiral around between an outer wall and some inner wall (internal or inside wall). Each may exit in the same plane or may be provided with an exit port (and possibly a block) to force all flow and all sound out an earlier exit port. In such an embodiment, the exit port for each spiraling path may be selected at a different location (height and circumference angle) in order to provide a different transit time and path length for each path.

In one embodiment, a stack of plates was machined, each plate containing a spiral path from an inside feed plenum to an outside exit port. This results in a different path length for each and, therefore, a different transit time. Each was fed through an inlet from a central tube as plenum to initiate passage through its respective spiral path. Within each plate in the stack of plates, a unique path was machined. Various offsets of time were thereby provided. In experiments, zero, one, two, six, and ten plates were combined in various combinations of specific paths with their specific transit times and corresponding path lengths to effect the reduction of sound amplitude by time-delay distribution.

In general one may specify a signal in, typically characterized by an amplitude of sound typically characterized by a waveform (shape) as a function of time. One may then specify (e.g., receive by regulation) the output signal (e.g., maximum amplitude) desired or required. It will typically be some amplitude limitation. One may determine what the mass flow needs to be in order to pass the exhaust gases through the system in some number of passages by breaking up a required total cross-sectional area into individual path areas. Sound is not dependent on such flow rates. Cross-sectional areas will typically be equal for each channel. These areas need not be so, but manufacturing and sound energy division certainly argue for a uniform cross-sectional area as a means to minimize the value of maximum amplitude and simplify manufacturing method.

Nevertheless, any path length and cross section may be calculated, and may be calculated according to aerodynamic requirements of fluid drag and flow as understood in the engineering arts. However, as a matter of sound, the sound waves travel "through" the medium at the speed of sound, not "with" the medium. The speed of sound depends primarily on the density of the gas and its temperature, not on its flow rate through the system. Sound waves travel much faster than most fluids travel in industrial equipment, vehicles, and so forth. Sonic and supersonic speeds in jets present their own gas dynamic systems, and are not considered at the moment.

One may determine the number of divisions, their lengths, and so forth based on maximum allowable amplitude output, which determines the number of paths and time offsets (transit times) to be achieved by the path lengths. Individual cross-sectional areas will necessarily depend on the number of paths, which should total at least the gross cross-sectional area of the flow path incoming from the source. The plenum should have a flow cross-sectional area larger than either.

There is no real need typically militating for any constriction through an apparatus in accordance with the invention. That is, outside of space concerns or an allocated envelope (volume and dimensions) available, a constriction of the total cross-sectional area need not be a major issue nor any limitation. Ultimately, an envelope or spatial constraint may be determined a priori. Thereafter, a specific shape may be selected.

For example, if a large area is available but very thin space, perhaps a sheet type or plate type multi-path system in a single plane may serve. If a compact volume configuration is desired a right circular cylinder (e.g., with aspect ratios of near unity) may be an effective way to create multiple paths of various lengths and transit times. In other embodiments, various paths may take various routes and need not be compactly configured.

For example, they may take unique and custom paths in various tubes. Tubes may themselves be arrayed to fit within right circular cylinder envelopes. They may also be stacked axially or added in series. Channels or tubes may be "nested" meaning that, as a group, they may fit within a common (shared) envelope. Envelope means the space defined by either the actual or maximum outer dimensions in all three ordinal directions (x, y, z, or axial, circumferential, and radial). Therefore, nesting may result in the spatial outline (envelope; occupied space) of one channel fitting inside the envelope of another or interleaved in some way to reduce the net volume. The total envelope is thereby not simply the addition of the individual envelopes for each channel. A cylinder is a mathematical definition meaning that a directrix (a straight line of fixed length, and at a fixed angle with respect to a defined space) moves about a closed curve to define an interior volume. For example, a right, circular cylinder is the volume defined by a directrix passing around a circle while oriented at a right angle with respect to the plane thereof.

Meanwhile, stacked plates, each with a unique, spiral path, may provide another configuration easily compacted and easily designed around arbitrary choices of channel lengths. Meanwhile, plates need not really be manufactured from solid material, but may be made of sheet metal. These may look like corrugated cardboard structures having serpentine channels between bounding planes of sheet material. Watch springs may serve as spacers (walls) between flat, sheet-metal plates to minimize mass and machining. Center feed and outer edge exits may be achieved just as with the plate prototypes.

Thus, one may engineer the routes or paths to be used from a fluid dynamic or aerodynamic point of view if desired. One may engineer (mathematically define) exactly predictable lengths, cross-sectional areas, and so forth for each path. Accordingly, manufacturing may take on any of the shapes or concepts described herein or others. The manufactured shape for each path may be referred to as a channel.

Installation may involve distribution through some marketing or sales network and technical installation as original equipment or as after-market equipment. To silence or quiet any type of device outputting an exhaust flow of gas, sound energy is subdivided in parallel, selectively delayed, and recombined in series to be quieted.

Operating a sound generating device automatically engages a sound attenuator system in accordance with the invention simply by passing its exhaust gases and their generated sound waves directly into a system in accordance with the invention to be subdivided, delayed, and released sequentially, thereby reducing maximum sound amplitude output.

One embodiment of a method in accordance with the invention may include passing sound waves, characterized by an amplitude having a first value as a function of time and a first maximum thereof, into a manifold. Sending the sound waves from the manifold through a plurality of paths, each characterized by a length corresponding thereto and selected between a minimum length and a maximum length subdivides the energy of the original waveform. It divides between the channels or paths. Meanwhile, the distance traversed by the sound waves will typically differ for each path providing passage from the manifold to a terminus, eventually releasing the sound waves into an environment therearound.

All lengths need not be unique, but offsetting the arrival of each instance of the waveform at a unique time minimizes the addition of energy, volume (amplitude), and so forth from each path. The result is reducing the amplitude to a second value as a function of time and a second maximum, each lower than the first value and first maximum, respectively, at the terminus by offsetting serially from one another arrival times of the sound waves at the terminus.

Providing a source of the sound waves, and connecting it to the manifold provides a flow of a gas through the paths, which typically constitute channels effectively sealed away from one another to resist fluid communication and sound propagation therebetween. Walls, formed of a solid material between paths typically have a second speed of sound therethrough differing from (much higher than) a first speed of sound through the gas. The solid material may be selected to be sufficiently stiff to effectively elastically reflect the sound waves in the gas.

Paths are characterized by lengths and exits corresponding thereto, the lengths differing sufficiently to displace in time from one another arrivals of the sound waves from each respective channel (path) at the exit corresponding thereto. One may select a number of the paths based on a desired reduction in the second value with respect to the second value. The number of the paths is selected to be inversely proportional to the ratio of the second maximum to the first maximum. For example, ten paths can be expected to reduce the amplitude (sound volume) detected at the exit (terminus) to a tenth of its value encountered at the source.

An apparatus may include a manifold capable of connecting to a source producing an event generating a flow of gas and a corresponding sound waveform comprising sound waves therein. The waveform is characterized by an amplitude having a first value as a function of time and first maximum value, passing through the gas. Channels operably connected to receive, at respective first ends thereof, the flow and waveform from the manifold will conduct them to corresponding second ends of the channels.

A terminus (end, whether manifolded or open to the environment) lies distal from the input manifold and is capable of passing (sooner or later) the flow to a surrounding environment. The channels, each characterized by a length selected between a minimum and a maximum are capable of being traversed by the sound waves within a periodicity corresponding to a period of the event causing the sound waveform. If not so, additive waveforms again would increase the sound amplitude.

The terminus is operably capable of releasing the sound waves to the environment at a second value of amplitude as a function of time, less than the first value as a consequence of differences between transit times of the sound waves through the channels. The channels are typically all characterized by a common cross-sectional area in order to divide energy equally. Gas dynamics may dictate other considerations for the flow of material (gas), which does not travel near the speed of sound.

The cross-sectional area may be configured in a common shape among all the channels. This may enable them to be arrayed within one another. For example, if the channels are arcuate (e.g., circular, spiral) in shape along the lengths thereof, each may have at least one full 360 degree traverse between the manifold and the terminus. The shape may be selected to fit within a spatial envelope based on space (shape, dimensions, etc.) available proximate the source. Some such shapes manufactured and tested include a right circular cylinder, a flat and planar shape having a thickness an order of magnitude less than either a width, length, or both thereof, a parallelepiped, or a wrapped bundle of layers.

A method in accordance with the invention may include providing a manifold operably connected to a first end of each channel of a plurality of channels, a second end of each thereof exiting at a terminus (end, exit). The manifold is capable of connecting to a source producing an event generating a flow of gas and a waveform comprising sound waves therein. The waveform is characterized by an amplitude having a first value varying as a function of time and a first overall maximum value.

Sound waves are passing through the gas, while the channels are operably connected to receive the flow. The paths or channels conduct both the waveform (at the speed of sound) and the flow (at the speed permitted by fluid dynamics principles) from the manifold to the terminus, and thence to an environment.

At the terminus, the sound waveforms have a similar appearance and a much reduced second value (function) of amplitude as a function of time. Since the individual transit times offset the arrivals of the waveform from each channel (preferably uniquely positioned in time), the second amplitude value is much less than the first value.

By connecting the manifold to a source of an event generating a gas and a waveform of sound, the gas and the waveform from the manifold pass into the channels. Differing path lengths delay arrival times at the terminus of the waveform proceeding through and eventually from each channel based on the extended transit times therethrough. Transit time is a direct function of the length, since the speed of sound is effectively constant at a constant temperature and gas composition. The amplitude of the waveform and the maximum value thereof are reduced by subdivision of their energy into the multiple channels and recombining in series, rather than simultaneously as they began.

The amplitude at the terminus is characterized by a second maximum value (function of time) less than the first maximum value, the ratio thereof being proportional to the number of channels selected. The channels are typically all characterized by a common cross-sectional area in a common, arcuate shape and arrayed within one another. They may be formed within a spatial envelope selected based on space available proximate the source.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

Figure 1:
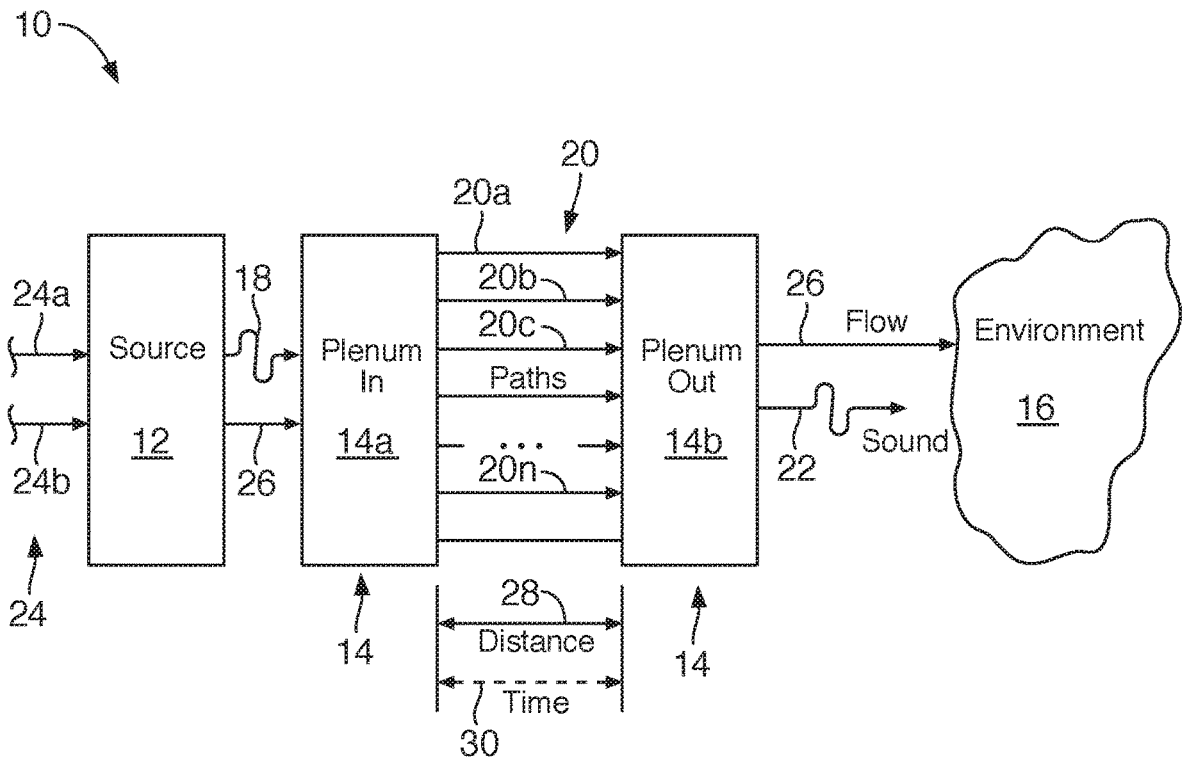
FIG. 1 is a schematic block diagram of one embodiment of a system in accordance with the invention.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout. Herein any reference letter indicates a specific instance of an item type indicated by its leading reference number. Thus, a reference number refers to such items generally, and with a trailing letter indicates a specific instance thereof.

Referring to FIG. 1, while referring to FIGS. 1 through 13B generally, a system 10 in accordance with the invention may include a source 12 of sound. Typically, a source 12 will be a generator of more than sound. For example, an industrial process, a stream of vehicle exhaust, a result of a reaction, a noisy mechanical vibration, or the like may all be fraught with regular or irregular waveforms, very high amplitudes (sensed as sound volume), and so forth that need to be attenuated, ameliorated, reduced, limited, or otherwise remediated for reasons of safety, communication, health, or the like.

Persistent, loud, or especially high-frequency sounds have a notorious reputation for destroying hearing of workers. Meanwhile, environmental regulations imposed on industrial environments, machines, vehicles, and the like limit the sound volume levels to which workers, customers, or others are permitted to be exposed, as a matter of law.

Thus, three approaches to sound attenuating include absorbing or otherwise reducing the sound escaping a flow originating the source, enclosing the source or potential hearers in a sound attenuating environment (room), and attaching a sound attenuator device at a receiver. This last is typically done by ear protection. For example, ear plugs, ear protection devices (headsets operating much like individual sound speakers, by providing attenuation of sound around the ears of a user), and the like are the typical mechanisms for protecting potential listeners from sounds.

In general, vehicles are only susceptible to the first of these mechanisms. A vehicle on a street or in an industrial environment is moving, and thus permits little or no control over who will hear its sound output. In contrast, an industrial plant or a specific, stationary motor, compressor, hammer, or other mechanical device in a fixed location at an industrial facility may be surrounded by a sound-reduction enclosure. Similarly, soldiers on a training site may be required to wear hearing protection inserted into the ear canal, worn over the ears, or both in order to attenuate the sounds of blasts.

One may think of a system 10 as including the source 12 or not including the source 12. In general, a source 12, is most often a result of a gas generation process or a reaction, such as combustion. The result from the source 12 is a gas stream 26 and a sound waveform 16 passing to a plenum 14*a* or an input plenum 14*a*. A system 10 passes into paths 20 a flow 26 of gases generated and the sound waves 18 or sound signal 18.

In an apparatus and method in accordance with the invention, the plenum 14*a* may subdivide both the sound 18 and the flow 26 between the various paths 20. In the illustration, the paths may include a first path 20*a*, second path 20*b*, third path 20*c*, up to some last path 20*n*. The paths 20 may include various cross-sectional areas or may all be of the same cross-sectional area. The first may sometimes favor equal division of the flow 26, while the latter has been shown herein to favor equal division of sound energy.

For example, in some environments, pressure recovery occurs as a result of distribution of a flow 26 of material (fluid) among various multiple paths 20. A plenum 14*a* reduces or negates that effect. However, sound waves 18, it has been found, do not suffer from the same redistribution or misdistribution as flow 26 will in some geometries.

Nevertheless, in general, the cross-sectional area through each of the paths 20 will typically be considerably smaller than the cross-sectional area through the plenum 14*a* or any plenum 14. Their total cross-sectional area when added together will typically still be less than it. That is, the sum of the areas of all of the paths 20 will typically be less than the cross-sectional area of the flow 26 in the plenum 14*a*. This occurs simply as a matter of simplified equalization of distribution among the paths 20. Nevertheless, it should be clear that equality of flows through the paths 20 is not required. Sound 18 travels independently from flow 26.

Usually, the individual paths 20 will each have a unique length. Typically, the point of having individual paths 20*a*, 20*b*, and so forth (see e.g. 20*a* through 20*k* in FIG. 9A) is to provide a difference in arrival times of the sound waveforms 18 through the various paths 20 when they each arrive at the outbound plenum 14*b*. Ultimately, the flow 26 leaving the outbound plenum 14*b* may be reconsolidated into a single flow. However, the individual paths 20 reconstruct in series, and may each simply discharge to the environment 16 directly.

It has been found, in accordance with the invention, that the input sound 18 may typically be characterized as a sound waveform 18 arriving at the plenum 14*a*. It will usually travel faster (at the speed of sound) than the actual flow 26 through the plenum 14*a* and through the paths 20. Thus, the division of the sound energy from the sound wave 18 appears to be independent from how much of the flow 26 is subdivided into or distributed into any individual path 20.

By the same token, the flow 26 exiting the plenum 14*b* may exit as the totality of the flows 26 from the paths 20 directly into the environment 16. There are benefits to both ways. Often, some screen, grid or the like, including a spark arrestor or the like, may be placed in the output flow 26 from a plenum 14*b*. Likewise, protective screens and shields may be necessary to prevent contact between persons and hot gases or heated surfaces. Protection may be required by law, regulation, convention, or good sense. Thus, compact construction for a system 10 may argue in favor of the presence of both the plenums 14*a*, 14*b* and a single conduit for the flow 26 into the environment 16.

A principal benefit of the individual paths 20 is that each will have a characteristic distance 28 unique to itself. The speed of sound is a function of the gas composition (typically characterized most prominently by density) and the temperature of the gas. Each individual distance 28 corresponding to a particular path 20 will therefore create an individual transit time 30 during which sound passes from the input plenum 14*a* to the output plenum 14*b*. It is this transit time 30 that provides an ability to reduce the maximum amplitude of a sound signal 22 exiting the plenum 14*b*. Again, the plenum 14*b* may be thought of as (or replaced by) simply an outlet 14*b* for the paths 20, whether or not the entire flow 26 is reconsolidated thereat before release into the environment 16.

Figure 2:
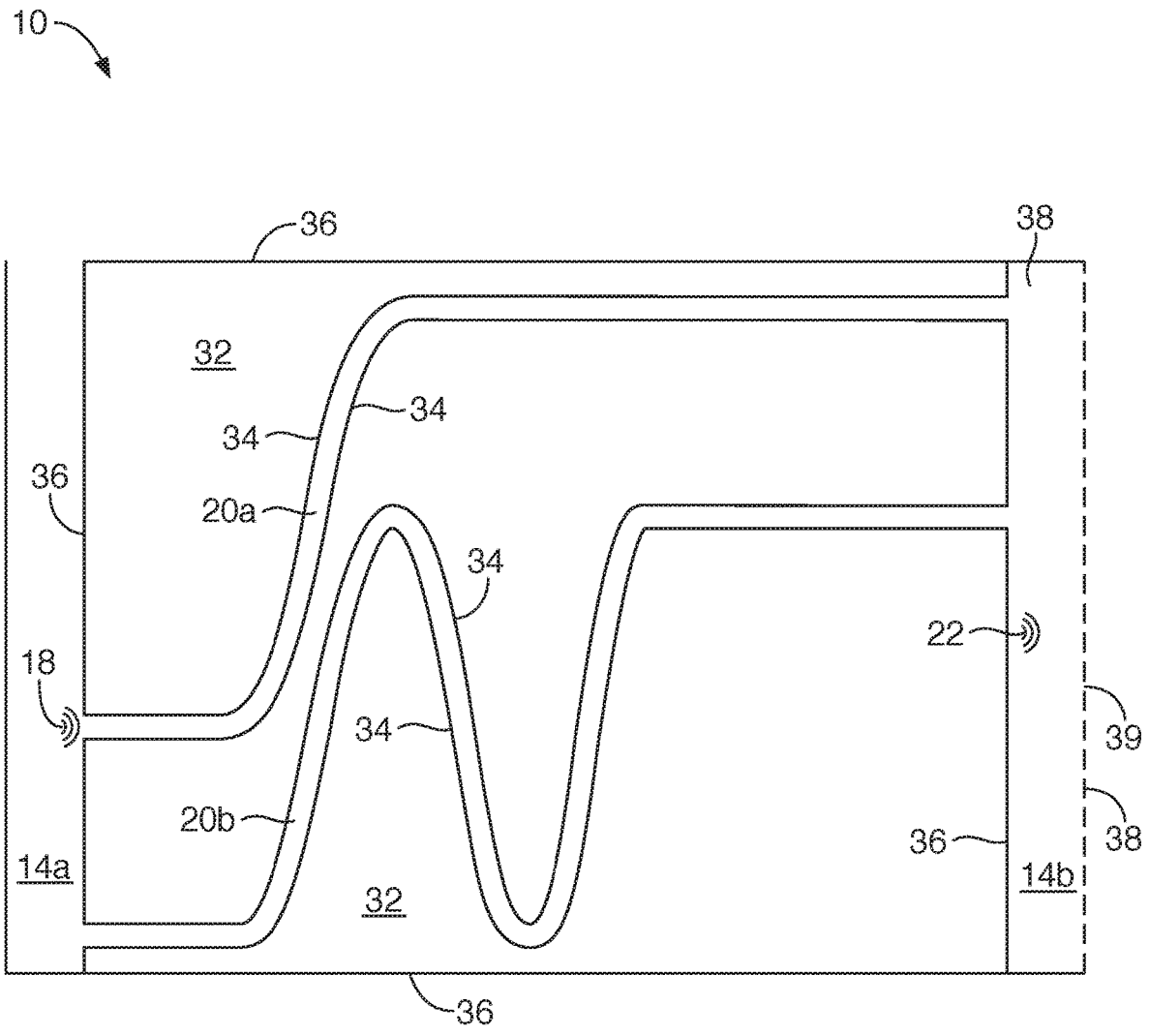
FIG. 2 is a top plan view of one embodiment of a set of multiple channels contained between plates thus providing a sound attenuator that is comparatively thin (aspect ratios of thickness to length and thickness to width that are comparatively small)

Referring to FIG. 2, in one example of an apparatus in accordance with the invention, a system 10 may be fabricated by creating a base 32. The base 32 may be formed of a solid material to be machined or a sheet. For example, the base 32 may simply be a flat sheet, such as a sheet of "sheet metal." Two layers of such a base 32 enclose channels 20, such as channel 20*a* and channel 20*b* in the illustrated embodiment. The channels 20 in the illustrated embodiment are represented as sinusoidal paths 20 each having a different effective length 28 or distance 28 from the inlet plenum 14*a* to the outlet plenum 14*b*.

Walls 34 extending between bases 32 may be formed by milling or machining into the base 32 in one prototypical embodiment. Alternatively, walls 34 are formed individually as perpendicular (to the base 32) projection 34 or walls 34 secured to the base 32 and extending away therefrom to an opposite base layer 32. If the base 32 is formed of a sheet material, then boundary walls 36 around the perimeter thereof may be required structurally. Likewise, bounding a plenum 14*a* feeding into the channels 20 may require that a boundary wall 36 be in place to direct the flow 26 and sound 18 into the channels 20.

In certain embodiments, a grill 38 or screen 38 provided with apertures 39 may enclose the plenum 14*b*. It may simply create the plenum 14*b* or may be added to arrest sparks, provide protection, shield hot surfaces from being touched, and the like.

In the illustrated embodiment, only two paths 20*a*, 20*b* are shown. However, various numbers of paths 20 may be provided in order to reduce the maximum amplitude (e.g., volume) of the sound 22 at the exit plenum 14*b*, which represents the exit 14*b* of all the channels 20.

Figure 3:
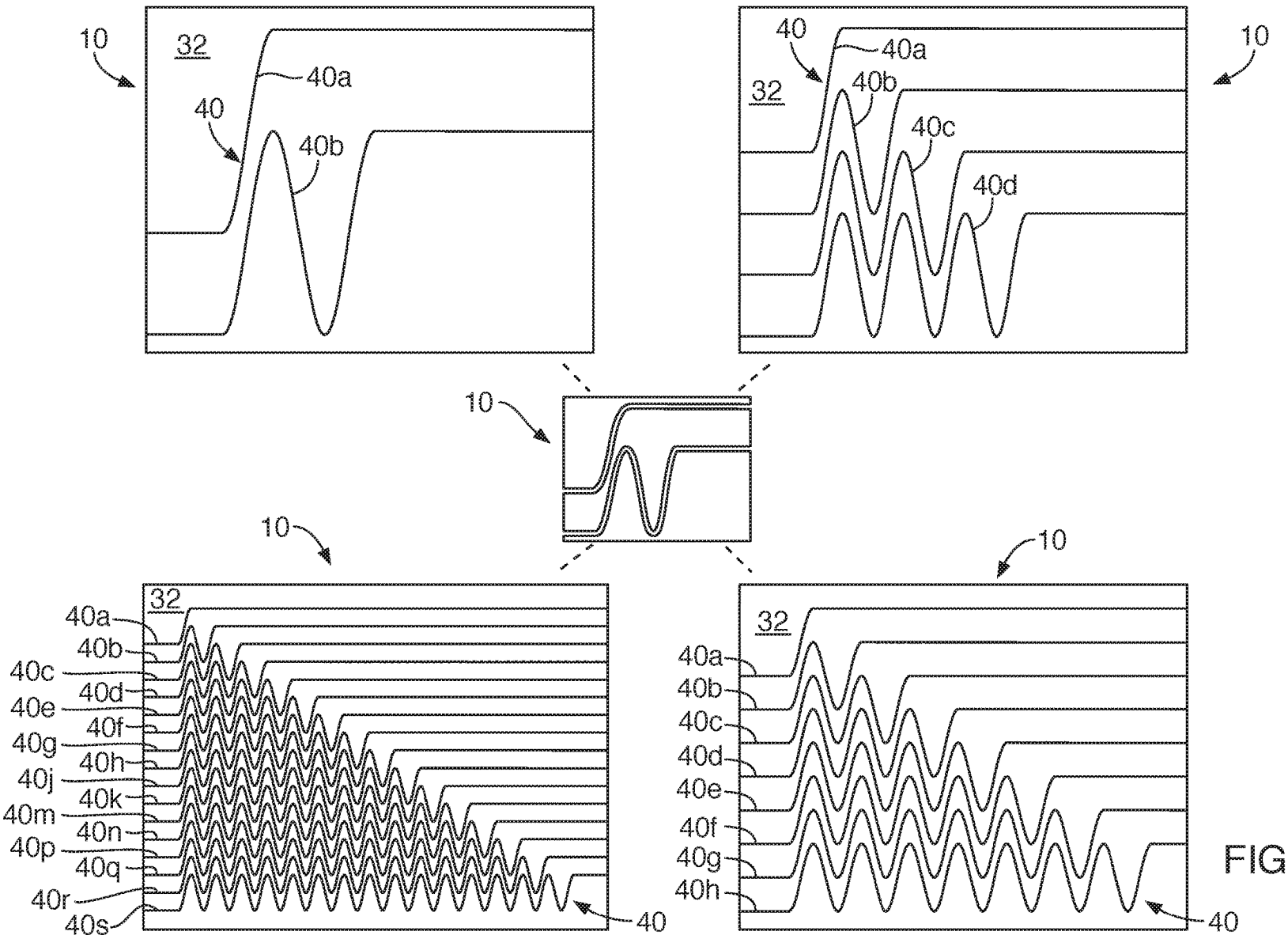
FIG. 3 illustrates top plan views of various embodiments of devices engineered to include two, four, eight, and even sixteen channels or paths through a comparatively thin thickness of plates using a sinusoidal path shape with multiple cycles (wave lengths) in order to provide differences in lengths, these illustrations defining each of the channels or paths according to its center line.

Referring to FIG. 3, while continuing to refer generally to FIGS. 1 through 13B, various calculated trajectories for the center lines 40 of each of the paths 20 are illustrated. One particular benefit of methods in accordance with the invention for designing and manufacturing systems 10 for attenuating sound is the ability to use mathematical functions to exactly define path lengths 28, in advance, for individual paths 20 to meet a sound remediation specification. That is, the specific individual transit time (proportional to distance) 30 for any individual path 20 may be engineered, calculated, and produced quite precisely.

For example, one will see two channels 20*a*, 20*b*, four channels 20*a* through 20*d*, eight channels 20*a* through 20*h*, and sixteen channels 20*a* through 20*s*. For example, the channels 20 illustrated in FIG. 2 resemble the center lines 40*a*, 40*b* in the upper left region of FIG. 3. Meanwhile, center lines 40*a* through 40*d* are required, and can be arrayed in the four channel embodiment in the upper right of FIG. 3.

Similarly, the eight channels 20 corresponding to center lines 40*a* through 40*h* are illustrated in the lower right, while multitudinous sixteen channels 20 corresponds to center lines 40*a* through 40*s* illustrated in the lower left corner. In general, any individual system 10 with its channels 20 may be engineered to select a distance 28 and a transit time 30 for passage along any of the center lines 40 illustrated. The point is to separate the arrival times at the outlet 14*b* without overlap. This can be done since the sound events 18 last for single digits of milliseconds and occur hundreds of milliseconds apart.

Figure 4:
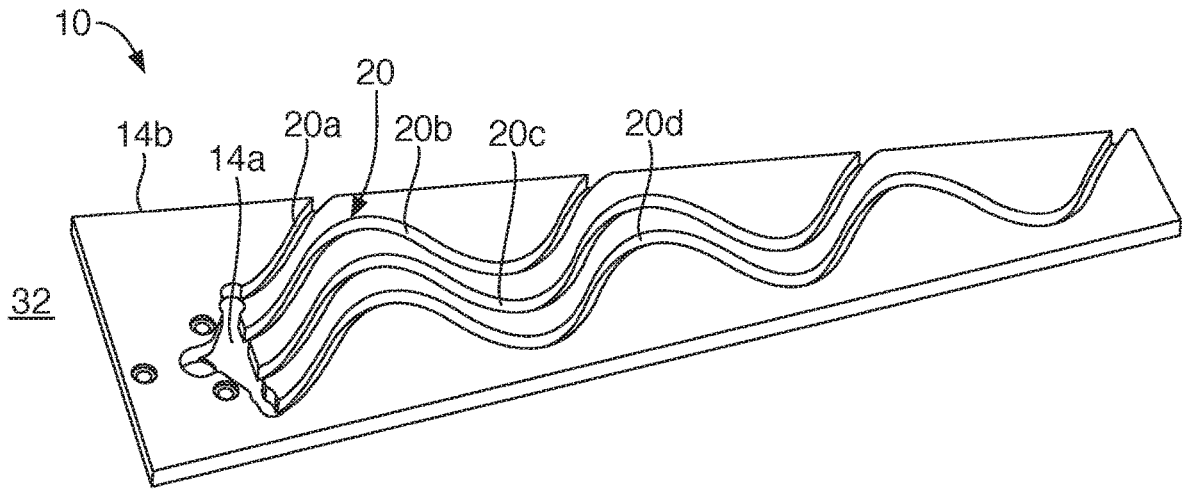
FIG. 4 is a perspective view of one embodiment of a plate-type sound attenuator in accordance with the invention.

Referring to FIG. 4, while continuing to refer generally to FIGS. 1 through 13B, a drawing illustrating a perspective view of a 4-channel system 10 is prototypical. Path lengths are defined by trigonometric (sinusoid) function. At the far left end of the illustration are shown mounting apertures for receiving fasteners and apertures for receiving an exhaust flow 26 from a motor 12. With a plurality of channels 20 (e.g., 20*a*, 20*b*, 20*c*, 20*d*) machined into a base 32, a thin sheet may serve as an opposite base 32 to close off each of the channels 20. One may see that the inlet plenum 14*a* has a cross-sectional area for the flow presented that is sufficiently greater than the total of the cross-sectional areas of the individual channels 20.

In this embodiment, the exit 14*b* terminates each path 20*a* through 20*d*. The length 28 of or distance 28 along each path 20 through 20*d* may be calculated analytically. No struggle with trial and error is required.

The sinusoidal wave shape that represents each path 20 is seen to traverse half a wave, a wave and a half, two and a half, and three and a half waves of the sinusoidal shape. Accordingly, each of the paths 20 differs from all others in length 28 or distance 28 traversed and consequently in the transit time 30 for a sound wave to pass therethrough. Again, the time for passage of the flow 26 need not be equal through each of the paths 20. Sound waves 18 travel independently from the flow 26.

Figure 5A:
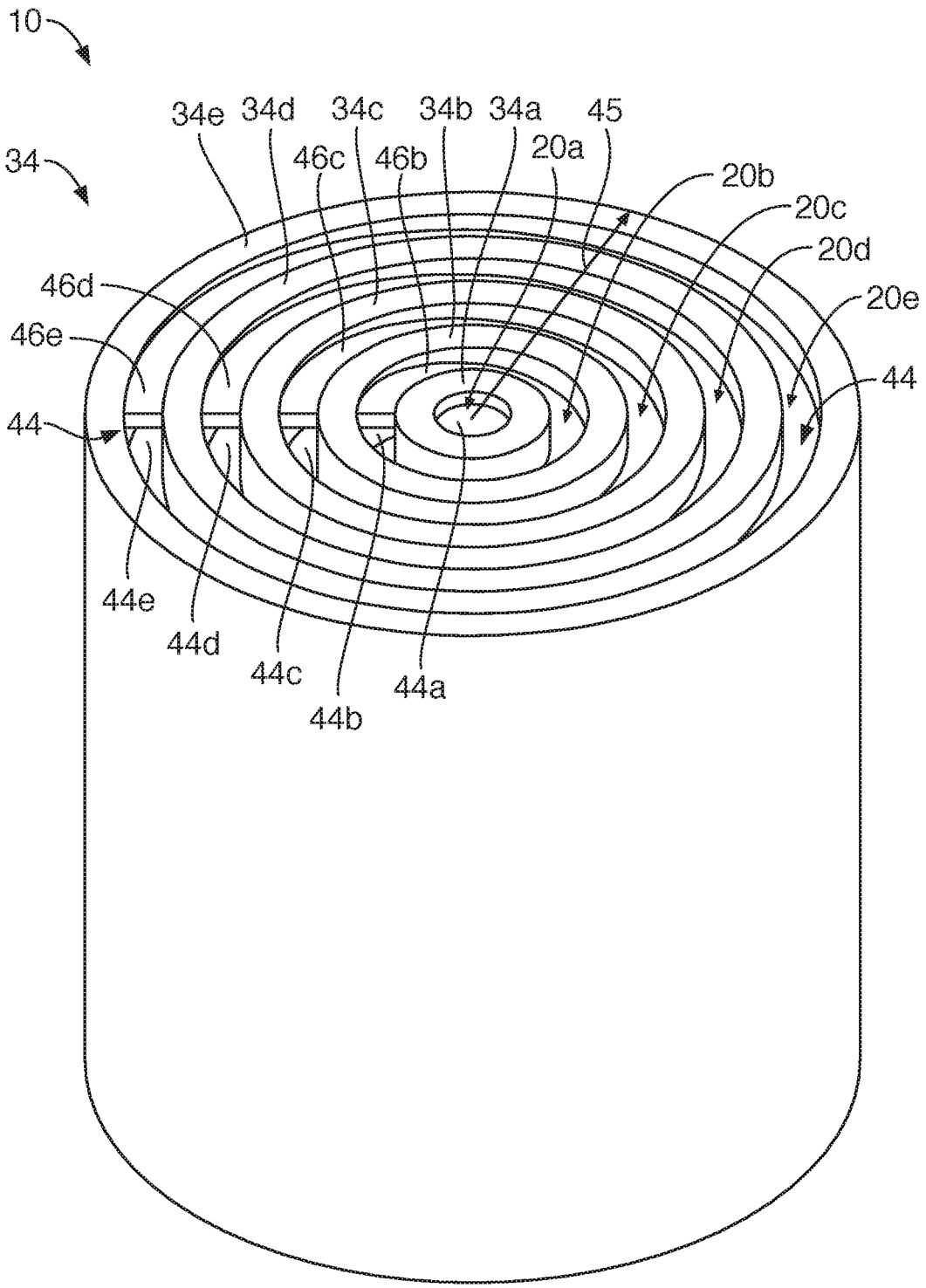
FIG. 5A is a perspective view of an alternative embodiment of sound attenuator relying on differences in radii of adjacent pathways to provide increasing variation in length (and transit time) as a function of radius in moving from one path to another.
Figure 5B:
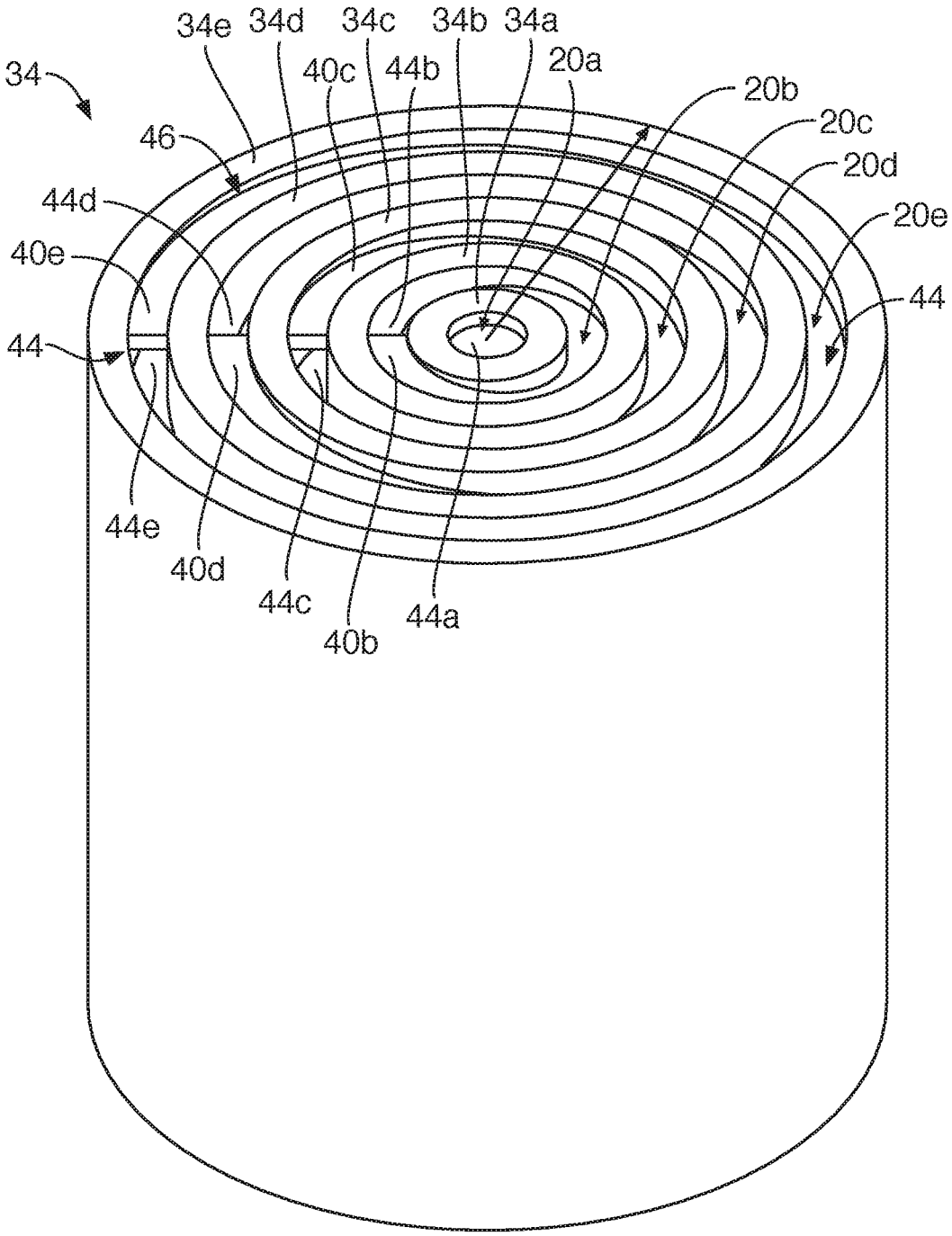
FIG. 5B shows a perspective view of an alternative embodiment thereof having radially adjacent paths passing in circumferentially opposite directions.

Referring to FIGS. 5A and 5B, while continuing to refer generally to FIGS. 1 through 13B, an alternative embodiment of a system 10 includes individual paths 20*a* through 20*e* helical in shape. The length for each is a direct consequence of the effective radius 45 (circumference is Pi×Diameter) times the number of turns within the height of the cylinder 34. In this illustrated embodiment, each of the paths 20 (e.g., 20*a* through 20*e*) will have a corresponding inlet 44*a* through 44*e*, respectively.

One manufacturing clarification may be provident at this point. The path 20*a* is illustrated as a direct path 20 through the system 10 to exit. This would necessarily be the shortest transit distance 28 and the fastest or shortest transit time 30 through the system 10. In some embodiments, the aperture 20*a* may be used as a receiver for a fastener or the like. In other embodiments, a central path 20*a* may simply be eliminated. Nevertheless, such a path 20*a* provides a nearly direct, not quite instantaneous, passage of a portion of the energy of the sound wave 18 entering the system 10.

The inlets 44*a* through 44*e* are all available at the top physical surface of the system 10. The pitch (distance per full revolution of each of the paths 20) are dictated by the circle, and all inlets 44 may be of exactly the same cross-sectional area. In fact, this has been found completely adequate, and no negative effects have been found in reducing sound by having the cross-sectional areas of all the inlets 44 equal. Sound 18 propagates as a wave, and carries a certain amount of energy. That energy ebbs and flows according to the form of the sound wave 18. Accordingly, it has been found that having all the cross-sectional areas of the inlets 44 equal provides for simplified design and manufacturing.

Referring to FIG. 5B, adjacent inlets 44 may be oriented, and their corresponding paths 20 spiral, in opposite directions. Flows 26 also pass through the paths 20. Flow has momentum. At discharge, that momentum causes thrust tending to translate (linear motion) or rotate (circumferential motion) the system 10. The alternating path directions help neutralize the net effective thrust of discharge of the flows 26.

In the illustrated embodiments, the vertical, right, circular cylinders 34 form vertical walls 34. For example, each of the walls 34*a* through 34*f* provides an outer boundary for a corresponding path 20*a* through 20*e*, respectively. One may think of the floor 46 or roof 46 as illustrated by the roofs 46*b* through 46*e* as forming both a roof 46, and a floor 46 for the same channel 20 on subsequent revolutions along the spiral pathway 20 thereof.

In some embodiments, it may be preferable to provide a closure 48 (see FIG. 6), in order to control more precisely a position and available cross-sectional area for a beginning point at which entry into an inlet 44 occurs for any particular channel 20.

Figure 6A:
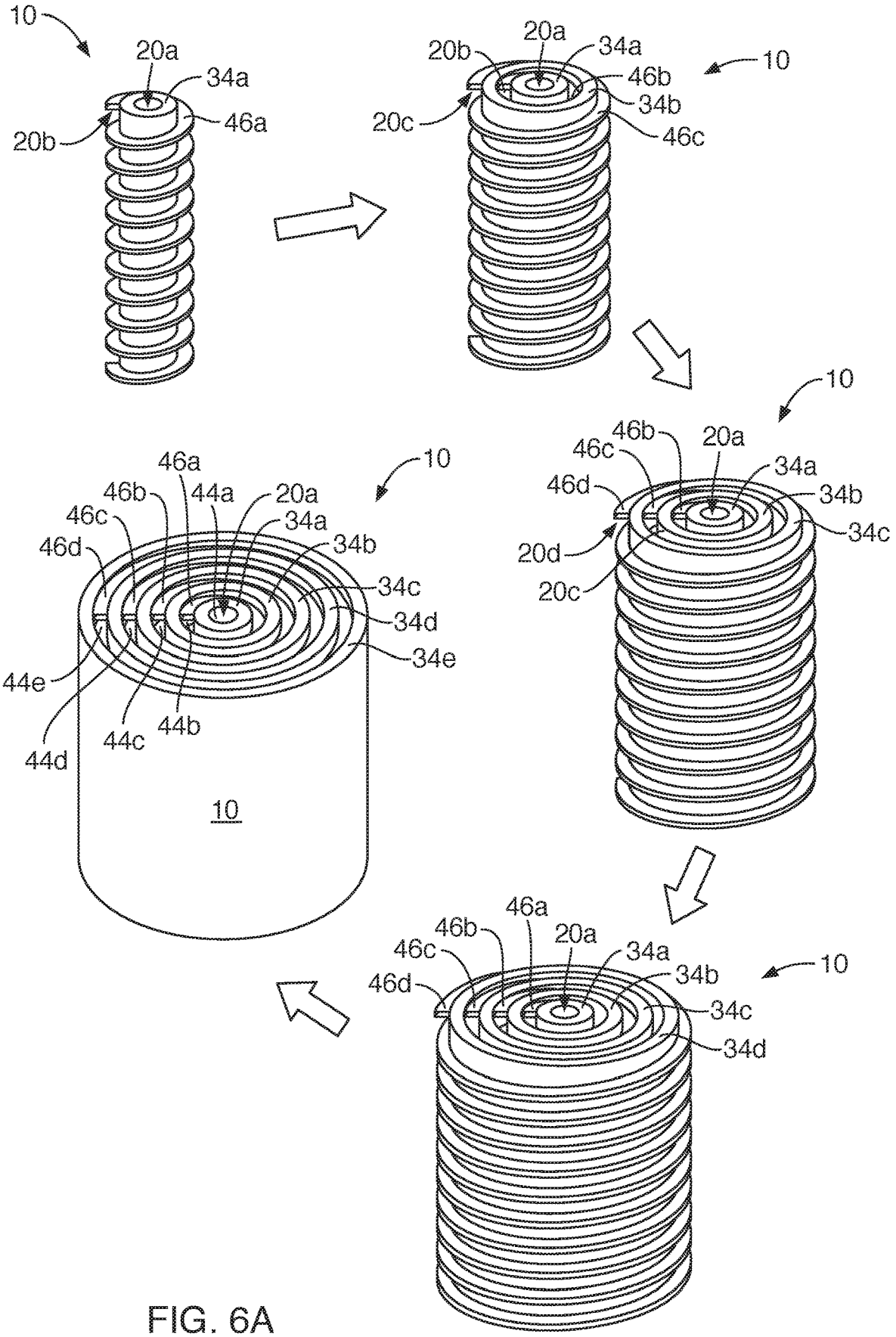
FIG. 6A is a perspective view of components in a process of assembling one embodiment of a sound attenuator according to the principles of the system of FIG. 5A or 5B, receiving flow at one axial end, and discharging at an axially opposite end, while passing the sound waves through multiple concentric spirals, each having a different length by virtue of its unique radius.
Figure 6B:
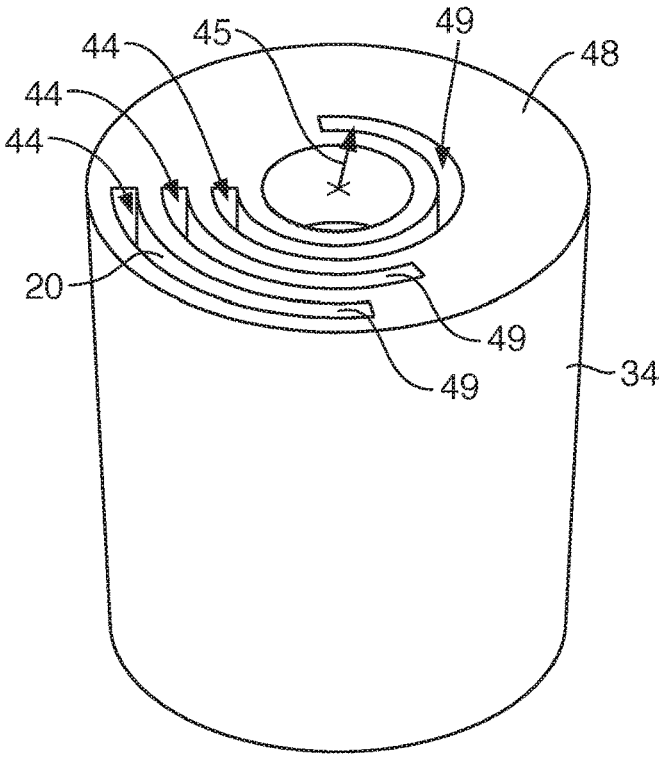
FIG. 6B is a perspective view of an upper closure with apertures configured to equalize access cross-sectional areas.
Figure 6C:
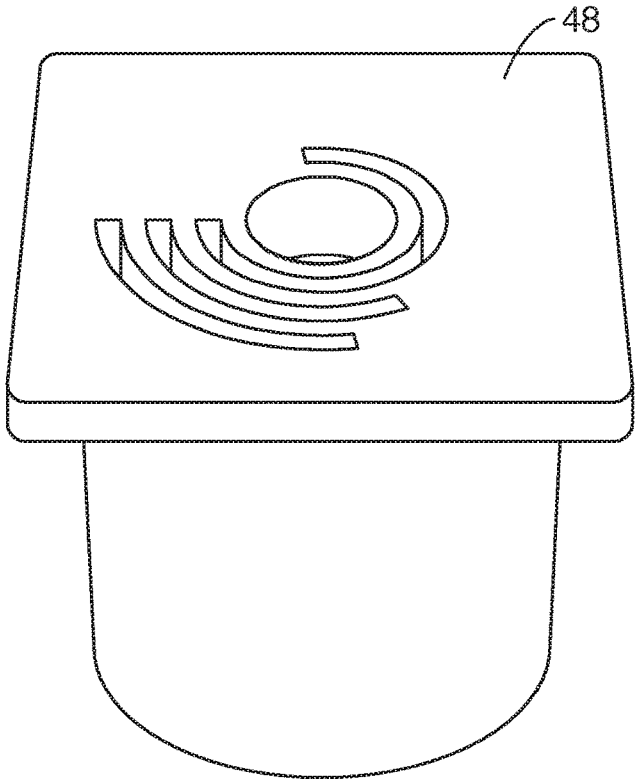
FIG. 6C is a perspective view of an alternative embodiment of a cap enclosing the apparatus of FIGS. 6A and 6B.

Referring to FIGS. 6A through 6C, while continuing to refer generally to FIGS. 1 through 13B, one manufacturing method for the system 10 of FIG. 5 is to form components that may be assembled. For example, one may provide an interior wall 34*a* represented as a right circular cylinder 34*a* defining an aperture 20*a* therethrough. Just as threads are formed on a screw or the blades are formed on a auger, the floor 46*a* and ceiling 46*a* may be formed as flutes 46*a* appearing much like threads 46*a* therearound.

The lengths 28 and transit times 30 through each of the passages 20 defined by the walls 34, 46 (floor 46 and ceiling 46 are also walls 34), are controlled by the radius 45 at which any particular channel 20 is located. The progression from a single channel 20*a* to a consequent channel 20*b* is established by each floor 46*a*, 46*b* inscribed by inner walls 34*a*, 34*b* enclosed by another right circular cylinder 34*b*, 34*c*, each enclosing its channel 20*a*, 20*b*. Accordingly, a floor 46*c* or ceiling 46*c* then defines channel 20*c* with the wall 34*b* being an inner wall 34*b*, while a consequent addition of a wall 34*c* encloses the channel 20*c*. Again, the channel 20*a* may be used for fastening or left unused, if not desired.

Ultimately, any desired number of walls 34 may be added, as illustrated by the walls 34*a* through 34*e* in the illustrated embodiment. The difference in each successive transit time 30 serves best if it exceeds the cycle time of the waveform 18.

Referring more specifically to FIGS. 6B and 6C, the closure 48 may be applied or assembled during manufacturing or thereafter of the various channels 20 with their walls 34 and floors 46. However, one may choose how much circumferential distance to leave an aperture 49 in the closure. This is in order to provide adequate access to, and cross-sectional area for, each channel 20.

A radical (e.g., right or acute angle) turn by gasses or sound arriving from an inlet plenum 14*a* into a particular inlet 44 causes substantial loss in flow momentum and may cause reflection of sound waves. In the illustrated embodiment, a difference in radius 45 exists at which each aperture 49 is found. Each may consume more degrees of angle in order to give the same distance of circumference leading up to the respective inlet 44 of a particular channel 20.

Figure 7A:
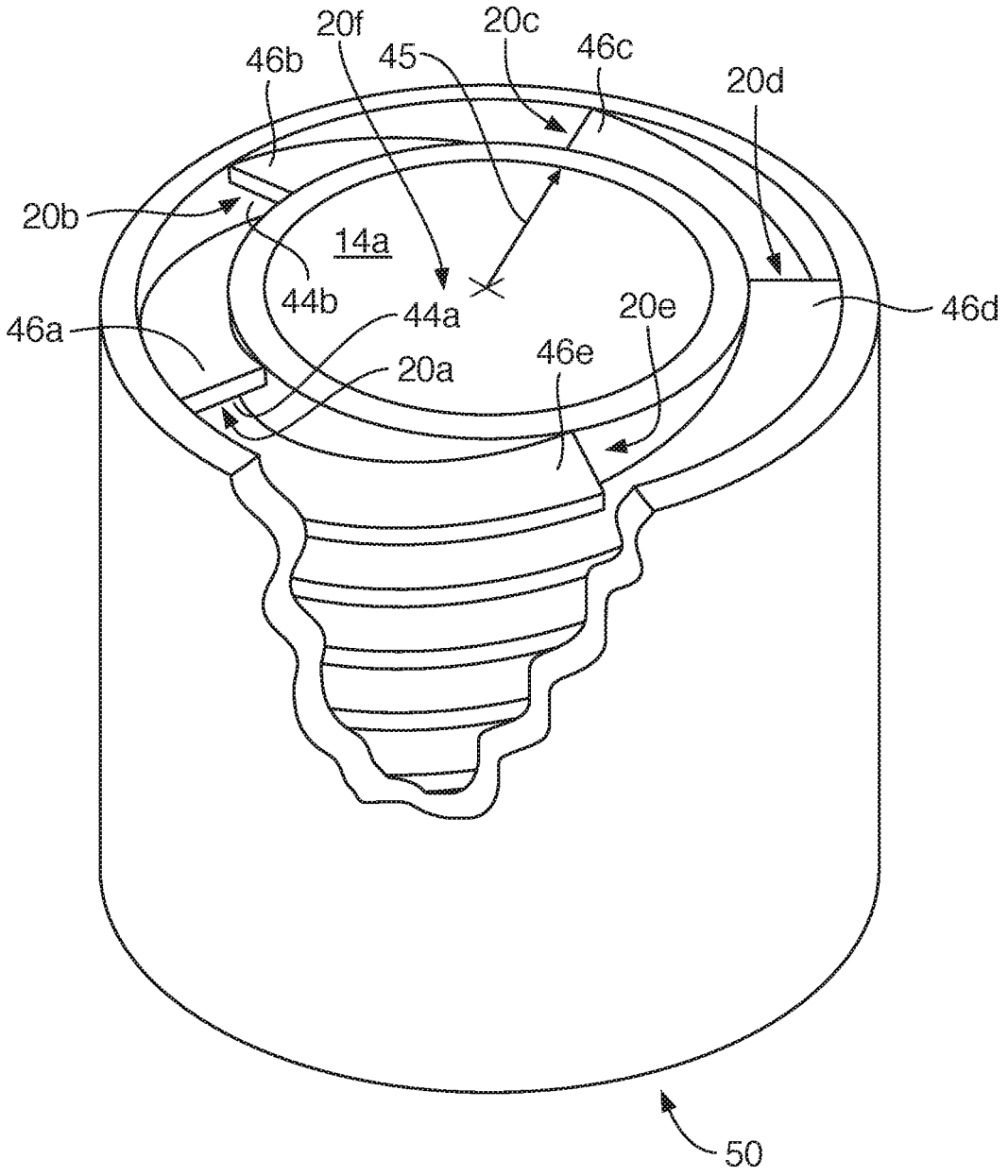
FIG. 7A is a partially-cut-away, perspective view of an alternative embodiment providing a first path, constituting a single, comparatively short, direct path through the center of the device, and a second path constituting an outer and longer path length, constituted by five paths, bounded by flutes at entry point like a multi-start-thread concept, resulting in five (or some other multiple of channels) constituting a single time delay (distance of travel) starting at one end (top of image shown) of a sound attenuator and terminating at the opposite (lower) end.

Referring to FIG. 7A, while continuing to refer generally to FIGS. 1 through 13B, yet another alternative embodiment for a system 10 in accordance with the invention may take on a right, circular, cylindrical configuration. Nevertheless, in this embodiment, the inlets 44 (e.g., 44*a* through 44*e*) are all set at the same radius 45 and all channels 20 (e.g., 20*a* through 20*e*) travel at the same radius, much like a "multi-start-thread" screw mechanism. That is, every channel 20 (e.g., 20*a* through 20*e*) begins at the same elevation and pitch at the top end of the system 10.

Figure 7B:
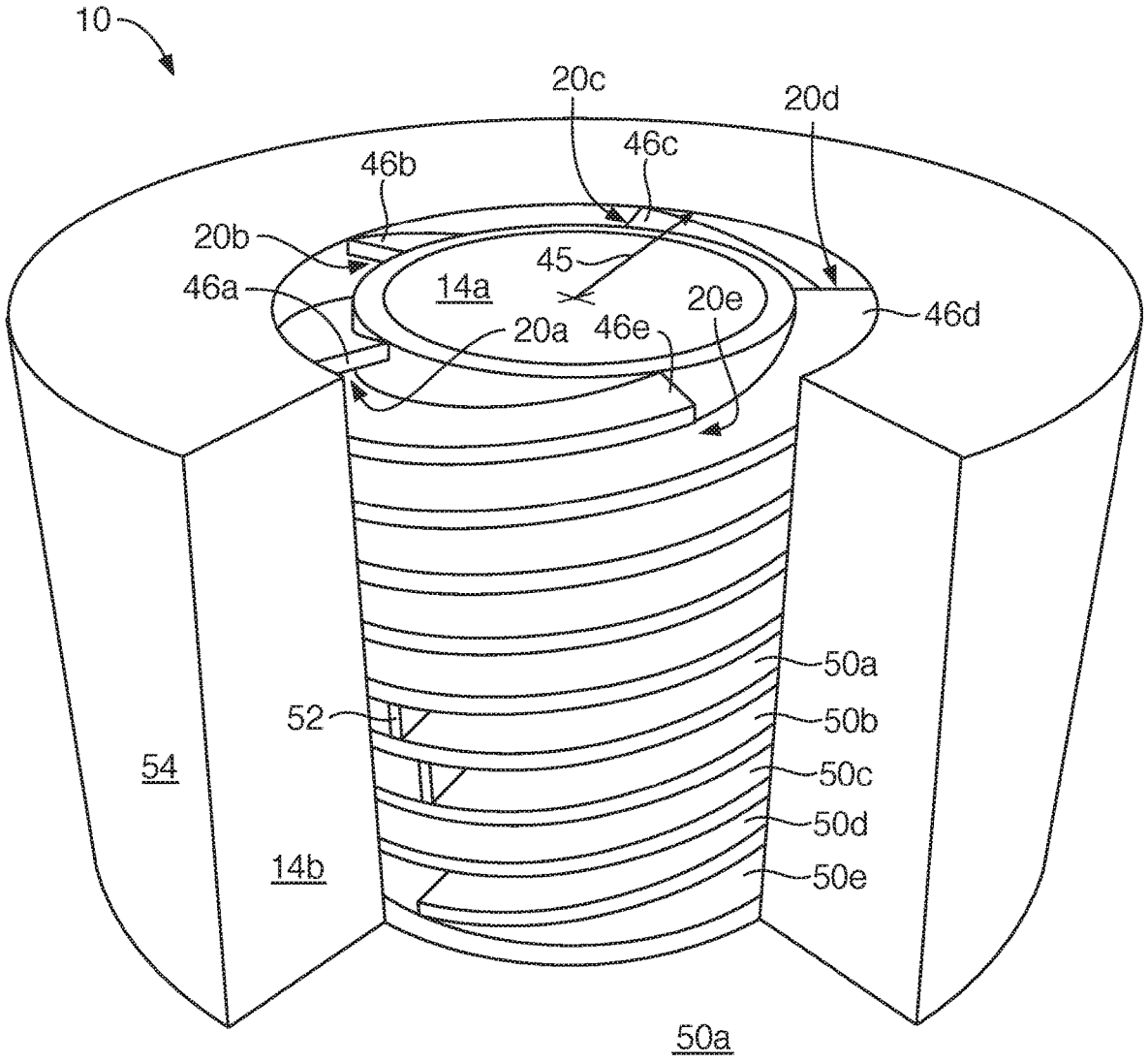
FIG. 7B is a cut away perspective view of an alternative embodiment wherein multiple outer paths terminate at different lengths, exiting thereat into a surrounding plenum.

Pitch (advance axially per full turn) is sufficient to provide for all five channels 20 to progress simultaneously at the same pitch rate. In fact, in this configuration pitch rates of all the outer channels may be identical. The embodiment of 7A is actually a 2-channel experiment. FIG. 7B shows a multi-path system 10.

FIG. 7A requires that an outer channel 20 be subdivided into channels 20*a* through 20*e* for two reasons. First, flow and sound may bypass the desired path if a single rotation (traverse) of the floor 46 occurs. By using multiple channels 20*a* through 20*e*, surrounding a central, shorter, more direct path 20*f*, no correspondingly short bypass route is available for the outer flow.

This is basically a 2-channel solution, with the outer channel being subdivided to equal the cross-sectional area of the direct path 20*f*, thereby equalizing sound energy between the paths 20*a* through 20*e*, respectively. Meanwhile, the "multi start" configuration obstructs any tendency of the flow to bypass the longer, spiraling paths 20*a* through 20*e* (the alternate, longer path 20).

Referring to FIG. 7B, in order to let one channel 20 be of a different distance 28 and transit time 30 from another, its pitch may be different such that it terminates in fewer revolutions, thus leaving more space for lower or subsequent channels 20 to continue to spiral through the mechanism 10. If individual channels 20 are all at the same pitch, then a separate discharge port 50 (e.g., 50*a* through 50*e*) will be required for each path 20 after it has traversed sufficient distance 28 or length 28. Similarly, a block 52 or stop 52 may be placed in any given channel 20 in order to motivate any flow of material and sound to pass out through a discharge port 50 to an exit plenum 14*b* or an environment 16 directly.

In the illustrated embodiment of FIG. 7A, having a constant and equal pitch on every floor 46 of every channel 20*a* through 20*e* protects against bypass flows 26. It also equalizes total cross-sectional area for each of the two path lengths 28 or distance 28.

For the configuration of FIG. 7B, such an equality of the paths 20*a* through 20*e* would waste a substantial portion of the volume of the system 10. On the other hand, if differences in pitch may be accommodated, then a particular channel 20 may have a pitch that maintains its position or its order with respect to all the other channels 20, but changes pitch of subsequent channels 20 remaining after it terminates. Each is put closer to itself the farther down the height of the system 10 it progresses.

In this way, a shorter channel 20 may be able to exit within a part of a revolution or a single revolution around the system 10, without progressing farther. The remaining channels 20*a* through 20*e* become closer to themselves or have less vertical offset between subsequent adjacent revolutions of their spiral path because intermediate previous paths have terminated.

The positions of the exit ports 50 or discharge ports 50 may be selected to occur at any particular location on a turn of a path 20 (any particular circumferential location). If no shielding is needed, then each of the exit ports 50*a* through 50*e* may exit directly to the environment 16. However, as discussed hereinabove, safety against heated surfaces may militate for some type of a shield 54 even if not needed to define an exit plenum 14*b*.

Figure 8:
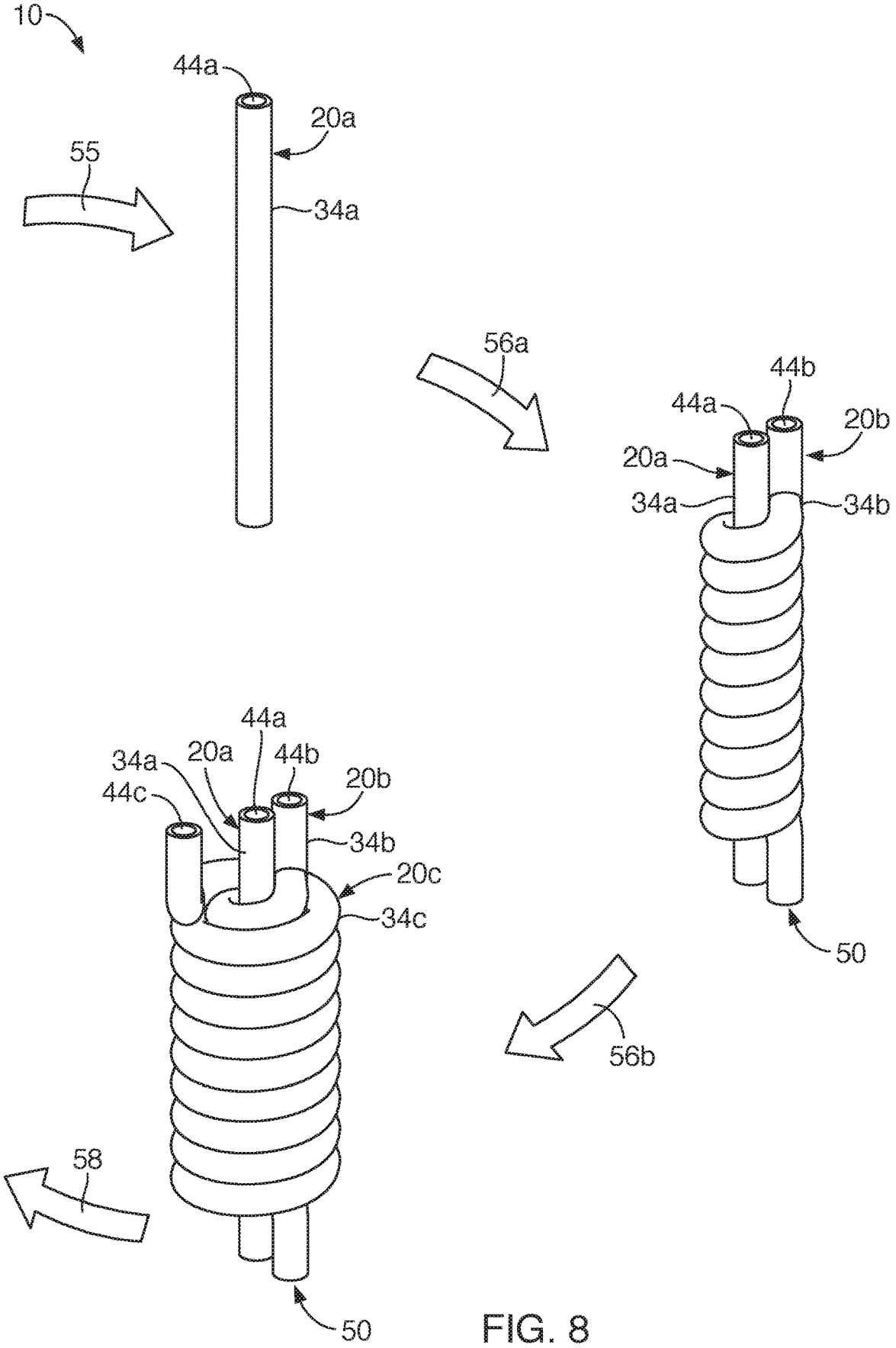
FIG. 8 is a perspective view of a process for assembling tubular cylinders as coils of tubular material formed as concentric spirals and arrayed inside one another.

Referring to FIG. 8, while continuing to refer generally to FIGS. 1 through 13B, one alternative embodiment may involve channels 20 (e.g., 20*a* through 20*c*) formed first as a direct path 20*a*, and then as subsequent coiled paths 20*b*, 20*c*, etc. successively fitted around one another. In this way, again, a radius 45 at which any particular path 20 is wound defines the length in terms of diameter times pi (it) multiplied by the number of turns or revolutions in a particular path 20.

In the illustrated embodiment, fabrication 55 of all the channels 20*a*, 20*b*, 20*c*, and so forth may occur first, after which assembling 56*a* a first coil around it and assembling 56*b* a second coil around both. The system 10 may be constructed with such a process, and followed up by other processes 58 or further processing 58. Such may include attaching plenums 14, providing connections, brackets, and the like to hold the system 10 and secure it to a source, plenums, or both, and so forth. Also, shielding 54 may need to be added regardless of the use or non-use of a terminal plenum 14*b* or outlet plenum 14*b*.

Figure 9A:
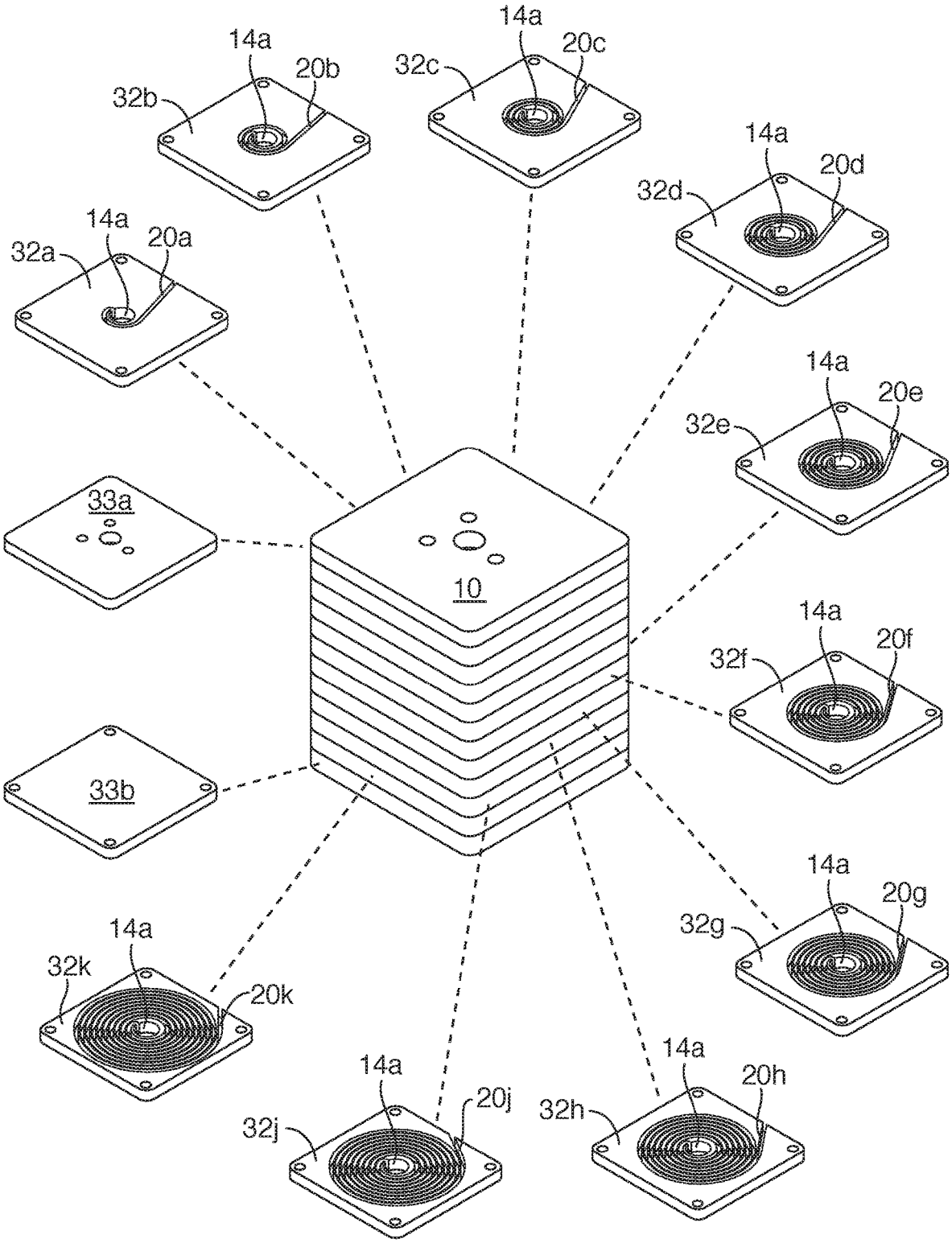
FIG. 9A is a perspective, exploded view of one alternative configuration of stacked plates, each having a unique spiraling path within its own planar space, thereby defining each unique path length and transit time from a central plenum through the path corresponding to each plate, and exiting (discharging) out an exterior surface at the edge of the respective plate.

Referring to FIG. 9A, while continuing to refer generally to FIGS. 1 through 13B, one alternate considered quite practical for prototyping and initial testing. It provided rapid construction by cutting individual paths 20 in individual plates 32. Individual plates 32 (e.g., base plates 32*a* through 32*k*) each contain not multiple paths 20 but a single path 20 (e.g., paths 20*a* through 20*k*) on each corresponding base 32*a* through 32*k* or plate 32*a* through 32*k*.

In this case, one advantage of the illustrated embodiment is that any number and any specific configuration of a channel 20 may be formed in any individual plate 32. In this way, the relative width and height defined in a cross-sectional area of any given path 20 may be defined for each individual plate 32. Then, stacks of specific cross-sectional areas, specific direction of spiraling, specific depths, specific widths, specific lengths of paths 20, or any combination thereof may be combined for testing.

Such was done. Results using no plates 32 and various combinations of up to ten plates 32 were tested in experiments as discussed hereinbelow. One will note that each of the channels 20 in this exploded view is connected directly to a central plenum 14, and exits out a specific edge of the corresponding plate 32. Again, any shielding 54, plenum 14*b*, or wall 34 surrounding such an exit plenum 14*b* may be provided for other reasons, but is not required for sound dissipation.

For example, by arranging the plates 32 of various orientations around a central axis or axis of symmetry of the outer shape of each of the plates 32, one may disperse sound not only according to its reduced volume (amplitude) but also its direction upon exit from the system 10. This will take advantage of further attenuation (through distance and space) of sound 22 exiting the system 10. Inputs may be made through an end plate 33*a*. This may be done by a central, axial, penetration collinear with the plenum 14*a*, or through a different path. At an opposite end, a capping plate 33*b* may close off the plenum 14*a*, since the paths 20 each exit through a penetration in a circumference of a plate 32 in this embodiment.

Figure 9B:
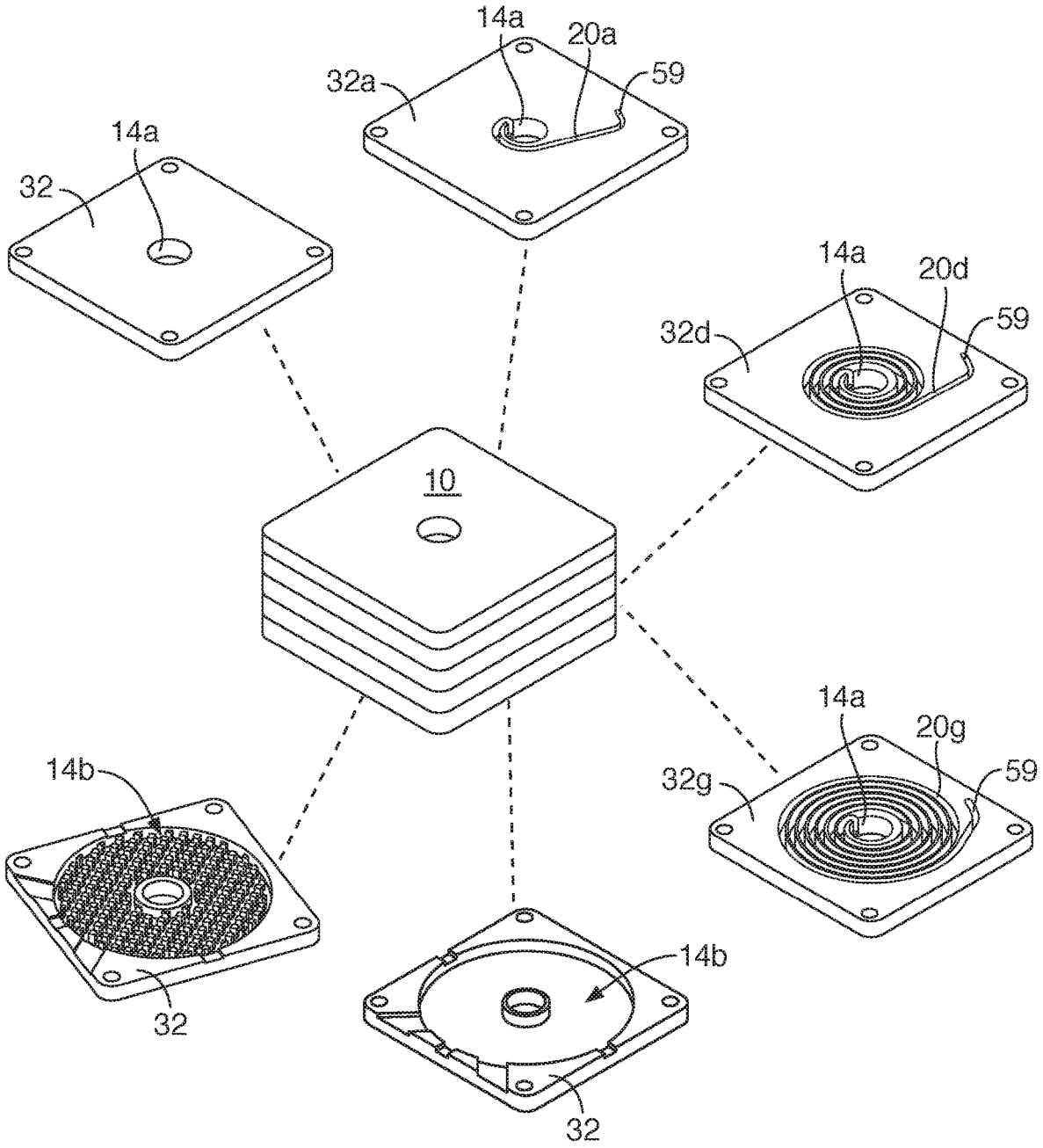
FIG. 9B is a perspective, exploded view of an alternative embodiment discharging normal (perpendicular) to each plate.

Referring to FIG. 9B, in one alternative embodiment, sound 18 and flow 26 may be divided and passed circumferentially, as divided, through each of the spiral channels 20 (e.g. 20*a*, 20*d*, 20*g*) respectively. Each spiral path exits perpendicularly (axially) through an aperture 59 at the outer end of the channel 20 in its respective plate 32 in order to reach an exit plenum 14*b* at an exit end (axially) of the system. Two alternative embodiments of a plenum 14*b* are illustrated, of which only one is used in any assembly. This may provide a more compact system 10.

Figure 10:
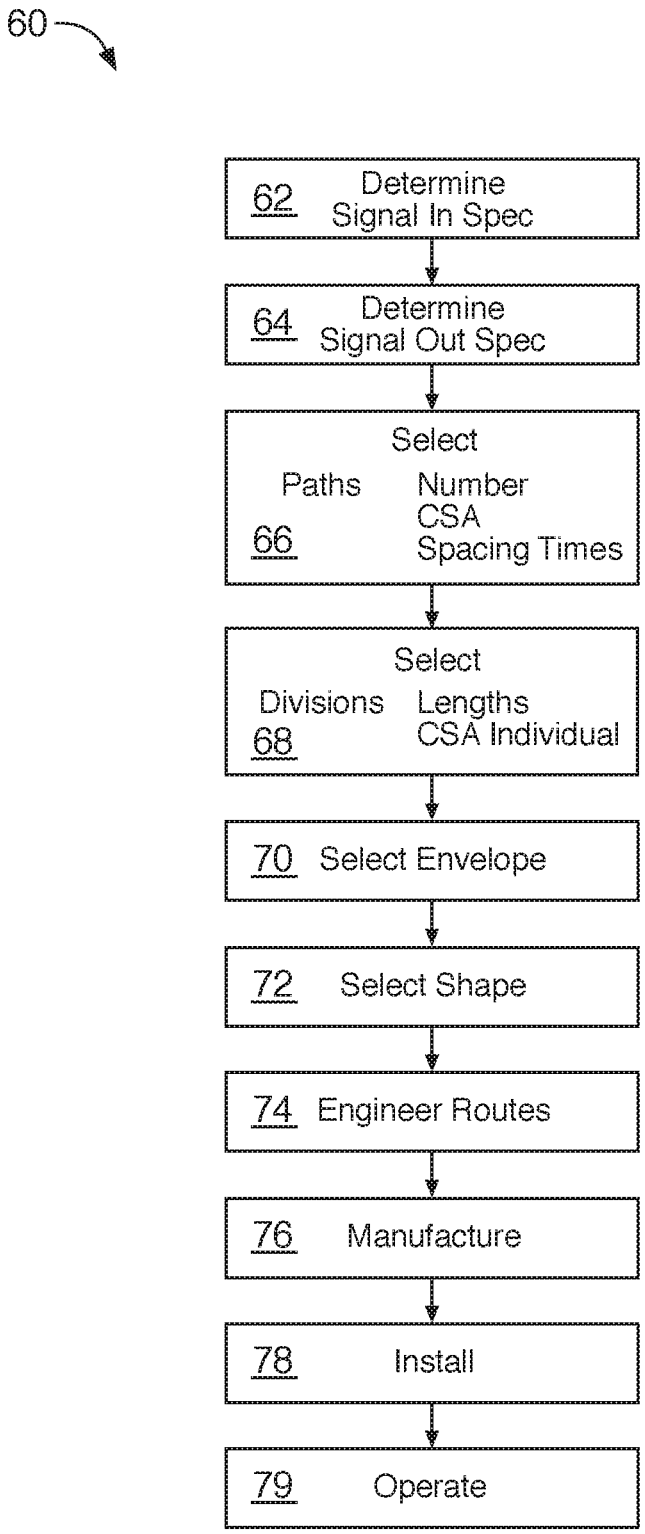
FIG. 10 is a schematic block diagram of a process for designing, engineering, manufacturing, installing, and operating a system in accordance with the invention.

Referring to FIG. 10, while continuing to refer generally to FIGS. 1 through 13B, one embodiment of a method 60 or process 60 for making and using an apparatus 10 in accordance with the invention may involve specifying 62 (e.g., the characteristics such as frequency, dB, etc.) an input signal 18 as a sound waveform 18 to be expected from a source 12. This may be provided as a technical detail of an engine or other gas generating device.

One may then determine or specify 64 (e.g., the characteristics such as frequency, dB, etc.) what a principal output signal 22 or output waveform 22 should be. For example, the maximum amplitude (volume) permissible under the circumstances may be regulated (a limit provided and required) by law. Alternatively it may be recommended as a work safety or health measure.

An outdoor situation may be very different from an indoor situation. Echoing from walls and resonance against internal structures may prevent ready dissipation of sound energy. That would not be typical of an outdoor environment where the signal 22 eventually propagates into a spherical mode of expansion in all directions.

In view of the source 12, and its output of a flow 26 and sound 18 one may define 66 the requirements for the paths 20. For example, one may determine what the cross-sectional area of all paths 20 needs to be to minimize restriction of the flow 26. One may calculate how many paths 20 will likely be necessary in order to reduce (literally subdivide) the amplitude 86 (see e.g., FIG. 11A) of the input 18 to obtain the approximate output signal 22 and its amplitude 90 (see e.g., FIG. 11A). These flows 26 and sound energies 18 may be modeled analytically to further estimate transit times 30 and amplitudes. Cycle times determine how frequently individual, sound-generating events occur in the source 12. These may limit how much time is available to spread out the transit times 30 for passage of the flow 26 and sound 18 through the system 10.

One reason for the definitions 66 includes the need to determine 68 characteristics of a path 20 for the individual divisions 20. For example, individual path lengths 28 are necessitated by individual transit times 30 required to offset the outputs of each path 20. Each preferably offsets with respect to all other paths 20. This may determine how many paths 20 or divisions 20 must be used in order to obtain the reductions desired.

With respect to the available envelope 70, it has been a common maxim in spatial allocation in vehicles that every cubic inch is already assigned and used by a component or subsystem. This may not be literally true but it is an attitude, and practically so. Accordingly, the envelope selected 70 is actually more likely imposed 70 by virtue of the source 12 to be served. That location and environment of the source 12 may dictate the selection 72 of specific shape, specific volume, specific dimensions, and the like available. Accordingly, one may select 72 (or receive a specification for) a shape or formulate 72 a shape within the available envelope provided 70.

For example, one may actually use one or more of the various embodiments in combination. Hereinabove, discussions have treated sheet metal constructions, assembled constructions, machined constructions, extruded tubular constructions, and so forth. Thus, multiple configurations are available. One or more may be used. Multiple configurations of systems 10 may actually be connected end to end.

For example, an input plenum 14*a* for one embodiment for a system 10 may actually operate as an output plenum 14*b* of a predecessor in the flow 26. Again, if spatial constraints are sufficiently demanding, this may be required.

Meanwhile, because the shape formulated 72 may vary from a comparatively thin, almost single-plate-like configuration of FIG. 4, or a rather consolidated and squatty (e.g., all aspect ratios near unity) configuration of FIG. 5, one has some liberty in design in order to meet a particular envelope 70 selected or imposed 70.

The tradeoff between "long and skinny," or "short and squatty" is not really a digital decision. Different regions may require each in turn. Certain requirements may require a pair of systems 10 in series (tandem). Likewise, various fabrication methods may provide an ability to use space not previously thought available.

For example, a sound attenuator may be built into a bottom pan of a car body, fender of a motorcycle, or supporting frame of an industrial engine. Also, the embodiment of FIG. 8 may be rendered longer and thinner to fit in narrow passages by staging the tubular channels 20. Not all concentric coils need be in multiple stacks of concentric layers. Perhaps some are concentric, and certain other combinations placed axially in series. One may thus reduce the overall diameter, trading for length, or vice versa. By having straight sections and coil sections (arrayed or not), such an embodiment may be done in a long tubular design. Effective lengths 28 and transit times 30 may be completely and arbitrarily designed according to the transit times 30 needed for sound reduction at the output waveform 22 from the input waveform 18.

Given the requirements and the shape formulated 72, the type of configuration will have been used as an input or will result as an output. An engineer may engineer 74 the particular routes 20 or paths 20 that will be used. Again, the input waveform 18, the output waveform 22, and particularly its maximum amplitude 88 (e.g., see FIGS. 11A through 13B), as well as the timing will control. They will eventually dictate the transit distances 28 and transit times 30 required of the individual paths 20 to provide optimal performance (minimizing the maximum output amplitude 88; see FIG. 11A) as discussed hereinbelow.

Manufacturing 76 a system 10 may thus proceed according to any of the designs hereinabove, combinations thereof, or others in accordance with the operating principles thereof. Material may depend on what the flow 26 constitutes as a chemical material, as well as gas temperature. For example, certain embodiments of systems 10 in accordance with the invention may be formed of plastics. Several molding, injecting, extrusion, wrapping, folding, and other fabrication processes are available. Similarly, 3-dimensional printing is also available, even in production today.

Nevertheless, temperature requirements often push material requirements to include robust metals such as steel, cast iron, aluminum, or the like. Accordingly, manufacturing 76 may accommodate both the sound attenuating requirements as well as temperature, mechanical stability, flow rates of the flow 26, and the pressure losses or fluid drag influences of passing through the system 10. However, sound waves 18 are not subject to the same physical constraints that the flow 26 requires. Accordingly, additional freedom of design in manufacture 76 is available.

Ultimately, installation 78 may include distribution to sites hosting particular sources 12 to be silenced or quieted by the systems 10. This may involve distribution as part of installation 78. In short, a product 10 manufactured 76 needs to arrive at a position to actually operate 79 as designed to reduce sound outputs 22 from a source 12. To that end, conventional sales, shipping, distribution, and the like may be considered a part of installation 78 as far as the present disclosure is concerned.

Referring to Figures to 11A and 11B, a chart 80 provides an axis 82 for amplitude and an axis 84 for time. The time axis 84 may be thought of as an "x" axis or abscissa. In the chart 80, it runs horizontally through the center of the actual data, the amplitude traces 86, 90, but may be drawn anywhere parallel thereto.

The amplitude trace 86 or curve 86 represents the waveform 18 as received from a source 12. In this particular experiment the source 12 was a gasoline fueled, internal combustion engine. The engine had a single piston and operated on a more-or-less regular cycle or operational frequency. One will see that the impulses or the maxima of the trace 86 are regular in time and also regular with a large, somewhat random variation in amplitude 82. In fact, one will notice that many of the amplitude peaks (maxima) are out of the range of the chart, having been clipped by the sensing device.

Here, time is measured in milliseconds along the abscissa 84 and amplitude is normalized (mapped or divided to be "dimensionless" in units) between the values of −1 and +1. Data is being taken at a rate of 192,000 Hertz. In the chart 80 illustrated, one immediately notices that the maximum amplitude 88 achieved by any portion of the curve 90 or trace 90 representing the output sound 22 or the attenuated sound waveform 22 has a substantially reduced value, and considerably more activity. This is because, as one will see more markedly later, that each cycle engineered is subdivided into six channels 20, each of which channels 20 has a unique distance 28 and transit time 30 through its distance 28, before being recombined in an output plenum 14*b*.

Thus, one may think of the trace 86 as sound energy in a waveform 18 being chopped up between the channels 20. Each portion is then physically phase shifted by the transit time 30 corresponding to its path 20 in the apparatus 10. The point here is that the maximum amplitude 88 of the trace 90 is substantially reduced from the saturating trace 86 originating at the sound of source 12. In fact, more subdivisions (paths 20) appear to proportionally reduce the amplitude 90 at the output.

Figure 11A:
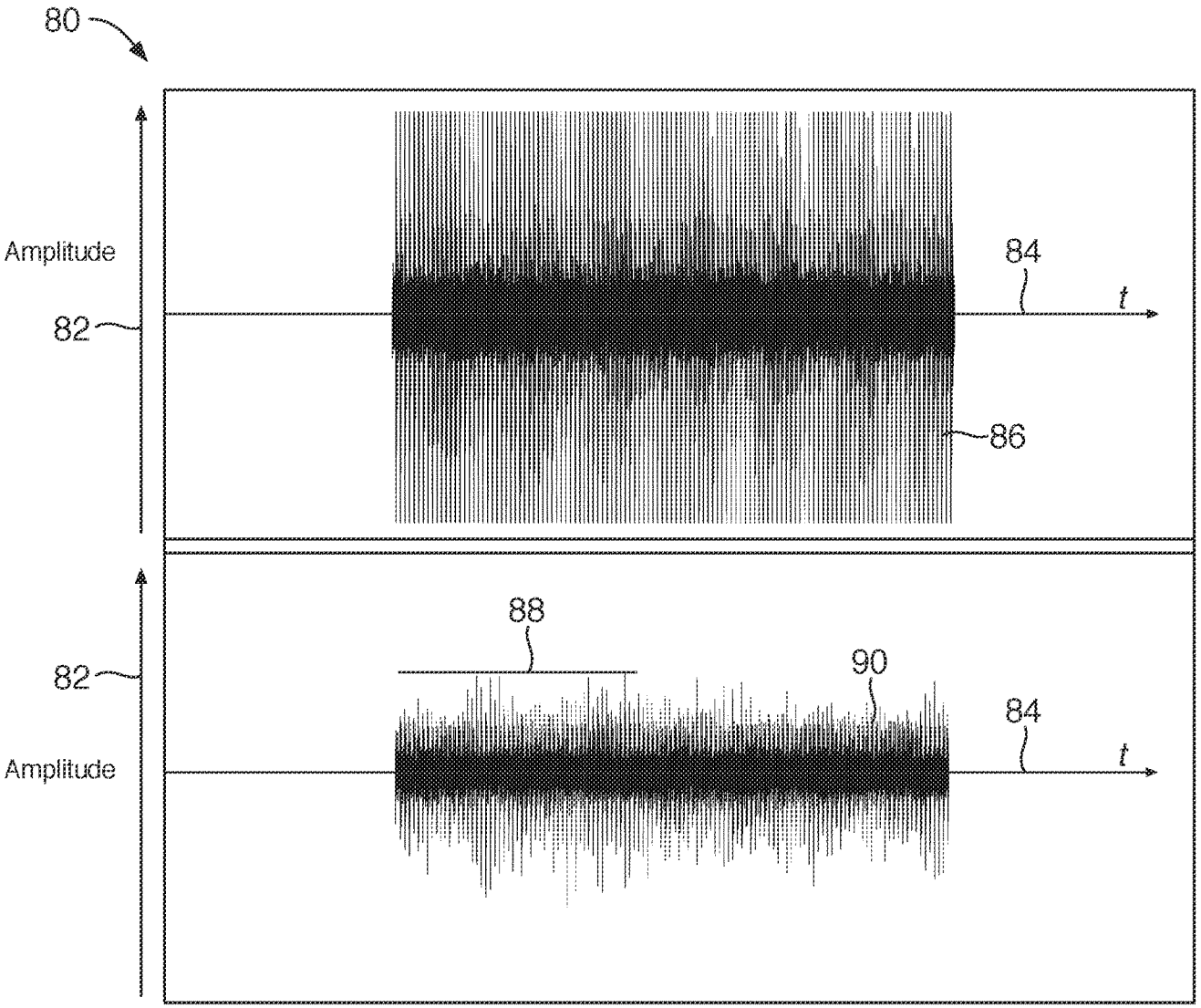
FIG. 11A is a chart of experimental data for an engine and illustrates an unremediated sound signature or waveform emanating from an engine, along with both its predicted and actual attenuated results after having passed through a system in accordance with the invention.
Figure 11B:
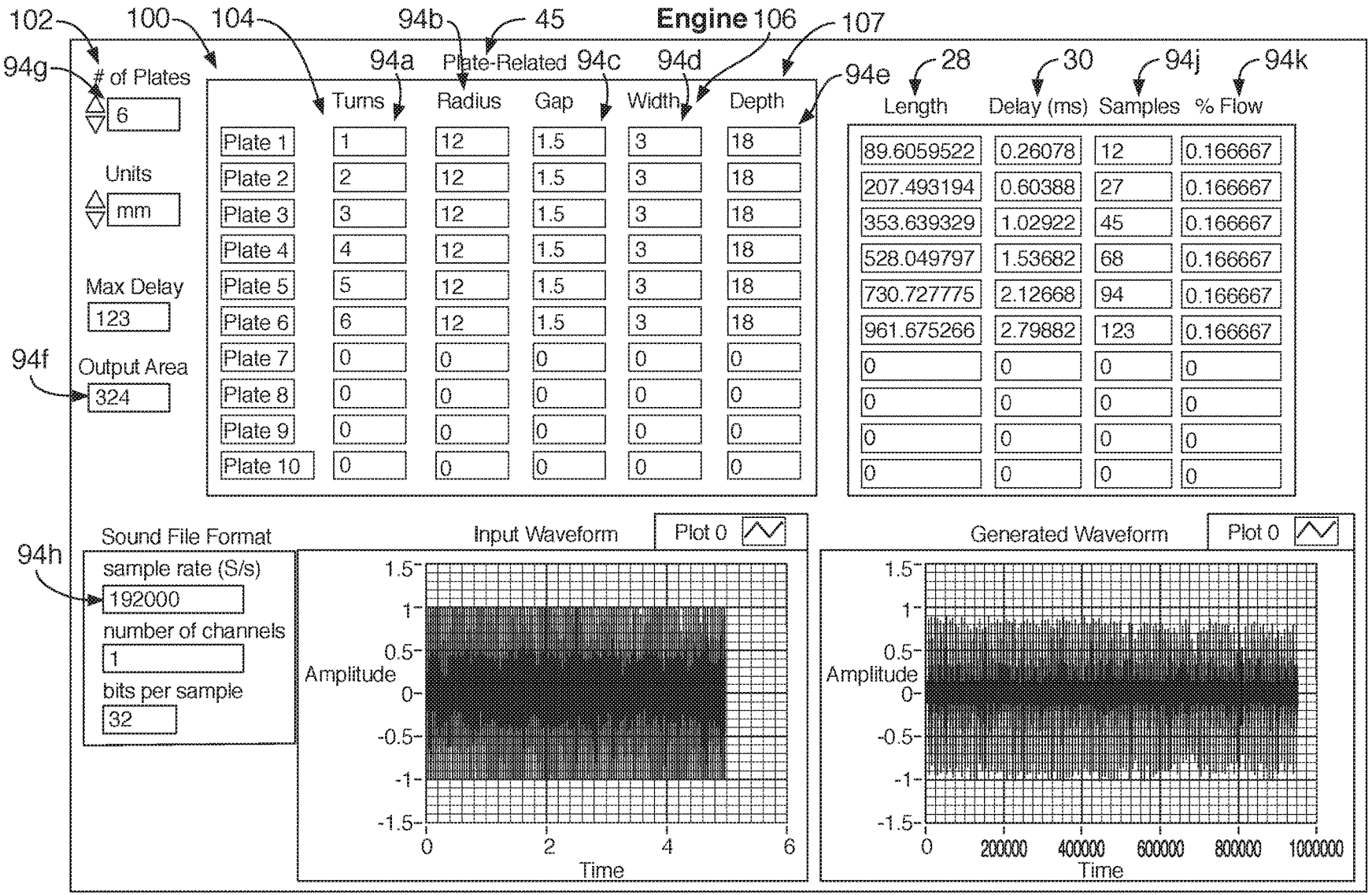
FIG. 11B is a chart of input values resulting in the data of FIG. 11A.

Referring to FIG. 11B, the data input conditions 94 are illustrated as a chart 100 of settings 94. The number 102 of paths 20 is represented by the number of plates 94*g*, each with its spiral path. The number of turns 104 is represented by the column 94*a*. The radius 45 of each individual path 20 is illustrated in the column 94*b* or radius column 94*b*. Similarly, the thickness 94*c* or wall 94*c* between adjacent channels 20 is shown in the column 94*c*.

The width 106 of each individual channel 20 is shown as the width column 94*d* while the depth 107 is shown in the depth column 94*e*. The total output area 94*f* is shown along with the lengths 28 corresponding to each of the plates 94*g* or paths 20 in entry 102 along with the corresponding transit times 30 characterized here as the delay 30 caused by the transit time 30 in the sample.

One will also note that the sampling rate 94*h* was 192,000 samples per second. The flow as illustrated in the chart at column 94*k* is equally divided among all the individual channels 20 constituted by the individual plates 94*g*. Samples taken are shown in the chart as the samples 94*j*.

The input data indicate 32-bit sensors, with samples taken over a period of about five milliseconds. The chart 100 illustrates that six plates were used, each having a length 28 identified in the column so identified, resulting in a transit time 30 or delay 30 in the column so identified. Meanwhile, the flow was divided equally among the equal cross-sectional areas (width 106 × depth 107) of all the paths 20.

In this particular experiment the first plate had a single turn on a radius of 12 millimeters with a wall providing a gap of 1.5 millimeters between the channels 20 while the individual width and depth for each channel 20 is as shown, the same for all. The only difference between the channels 20 was the number of turns or revolutions, and consequent path length 28, of each path 20 about a central axis.

Figure 12A:
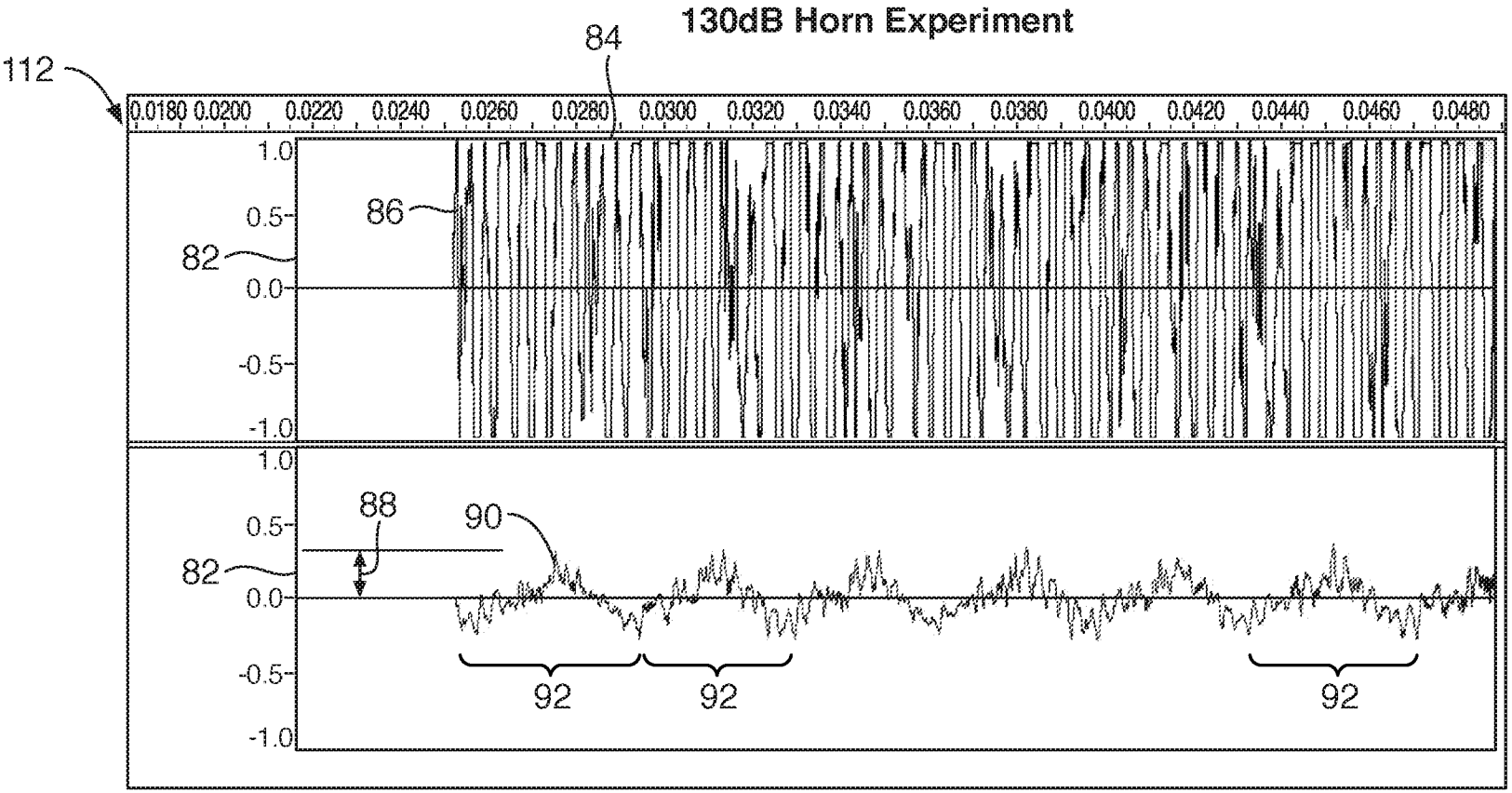
FIG. 12A is a chart of the input waveform and output waveform resulting therefrom in a horn.
Figure 12B:
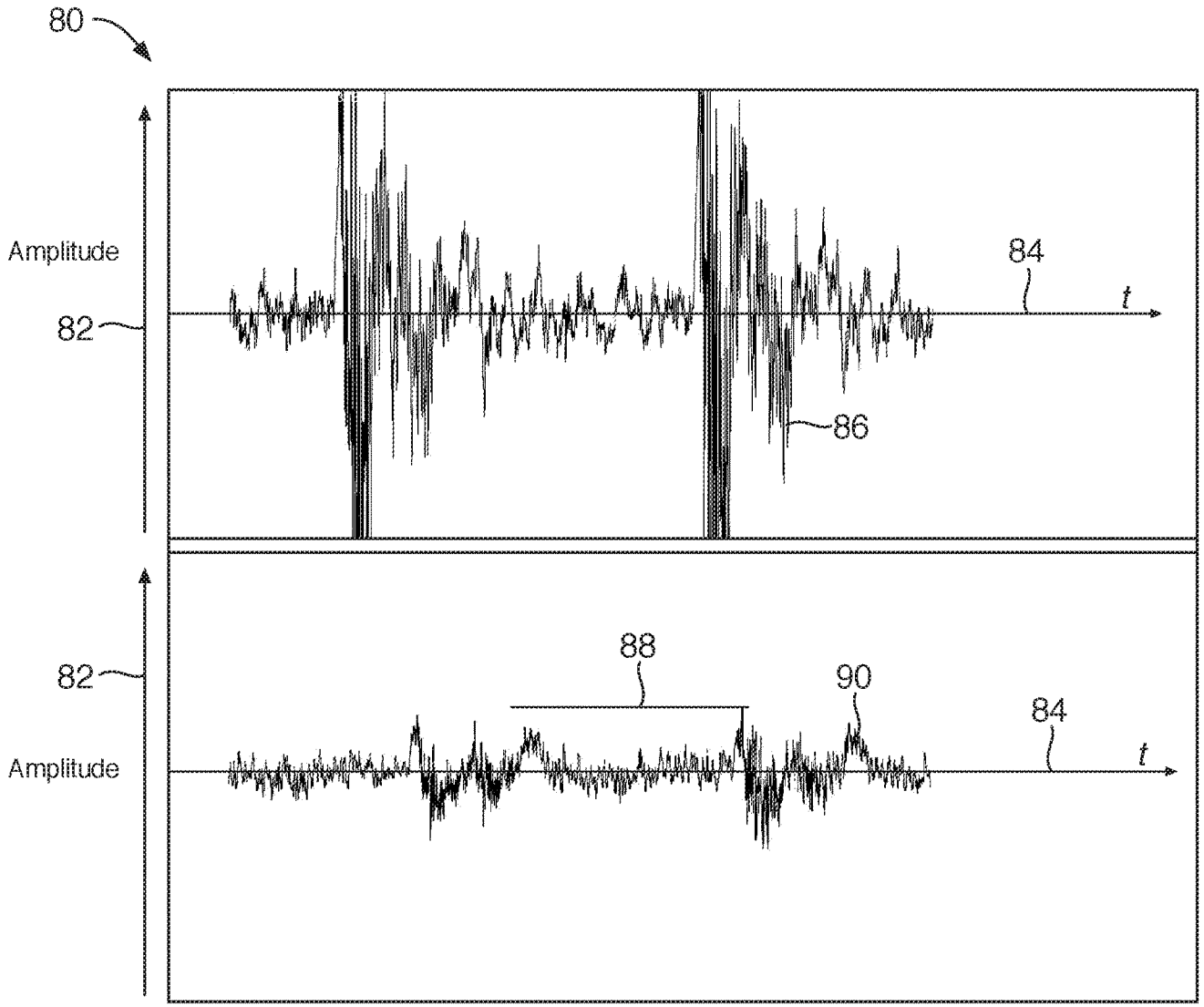
FIG. 12B is a chart illustrating two cycles of those sound waveforms from the horn of FIG. 12A and its response from a system in accordance with the invention, with a substantial reduction in amplitude, yet the waveform artifacts illustrating that the delays have indeed been imposed upon the different paths or sound waves through the different paths, thereby providing a repeating pattern of those artifacts of the waveform input as evident in the output.

Referring to FIGS. 12A and 12B, while continuing to refer generally to FIGS. 1 through 13B, the chart 112 relies on the same abscissa 84 or time axis 84 and amplitude axis 82. The raw trace 86 represents the amplitude 86 as directly sensed from the source 12 into the plenum 14*a* as illustrated above. FIG. 12B is an expansion of two cycles from FIG. 12A.

The input data for a horn indicate that the horn has a 130 decibel sound volume and provides a signal that is ostensibly at a wave length of 435 Hertz. That is, the tone is close to the tone or note "A," which is 440 Hertz, this being at 435 Hertz. The sound speed is 343 meters per second, meaning that the wave length of the signal is 789 millimeters per cycle.

With an ostensibly sinusoidal waveform 18, the period of amplitude above the zero amplitude 82 on the axis 82 lasts for about 394.5 millimeters followed by the below-zero amplitude. Thus, the introduction of a 394 millimeter, and therefore 394 millisecond, delay pushes the upper fraction of the waveform 86 or trace 86 over the negative portion arriving through an adjacent, delayed channel, thereby smoothing the maximum amplitude. Some argue that waves do not actually cancel, but simply superimpose their effects. However, to a listener, the result is as if the waveform 86 were canceled.

Meanwhile, the trace 90 represents the actual attenuated signal 22 emanating from the system 10 after attenuation. Here, one will notice more clearly the artifacts 92 that tend to repeat themselves in the attenuated signal. This repeated pattern is typically a direct result of the signal 26 having been subdivided and delayed through each of the individual channels 20 and then recombined in the exit plenum 14*b*.

One will notice a precipitous drop in the saturating amplitude 82 of the original trace 86 representing the input waveform 18, as compared to the output waveform 90. The maximum amplitude 88 is reduced substantially by virtue of shifting (offsetting) the sound energy "portion" of the waveform 18 in the channels 20, offsetting each to a different time slot and opposite waveform. Miniature waveform artifacts 92 remain. Each artifact 92 demonstrating its relation to the originating trace 86.

Referring to Figures to 13A and 13B, the chart 80 again illustrates the horizontal abscissa 84 representing the time axis 84, while the amplitude axis 82 is vertical. Over the period of time observed, one will see that the trace 86 of the original signal is substantially greater than that of the attenuated amplitude curve 90. Meanwhile, one will notice that the characteristic artifacts 92 seen in the larger amplitude curve 86 above it still appear. They are distributed out by their time delays to follow each other.

This experiment relied on a single gas generating event caused by a single combustion of a single charge. That single charge gave rise to the amplitude curve 86 which was attenuated by being subdivided and spread (multiplexed) in time. One may think of this as a mechanical, time-division multiplexing. Here, the sound waves are literally delayed. The mechanical delay occurs by an extension of the distance 28 traversed in a path 20. This results in a transit time 30 through a path 20, which amounts to a delay 30 illustrated in the charts of FIG. 13B.

Figure 13A:
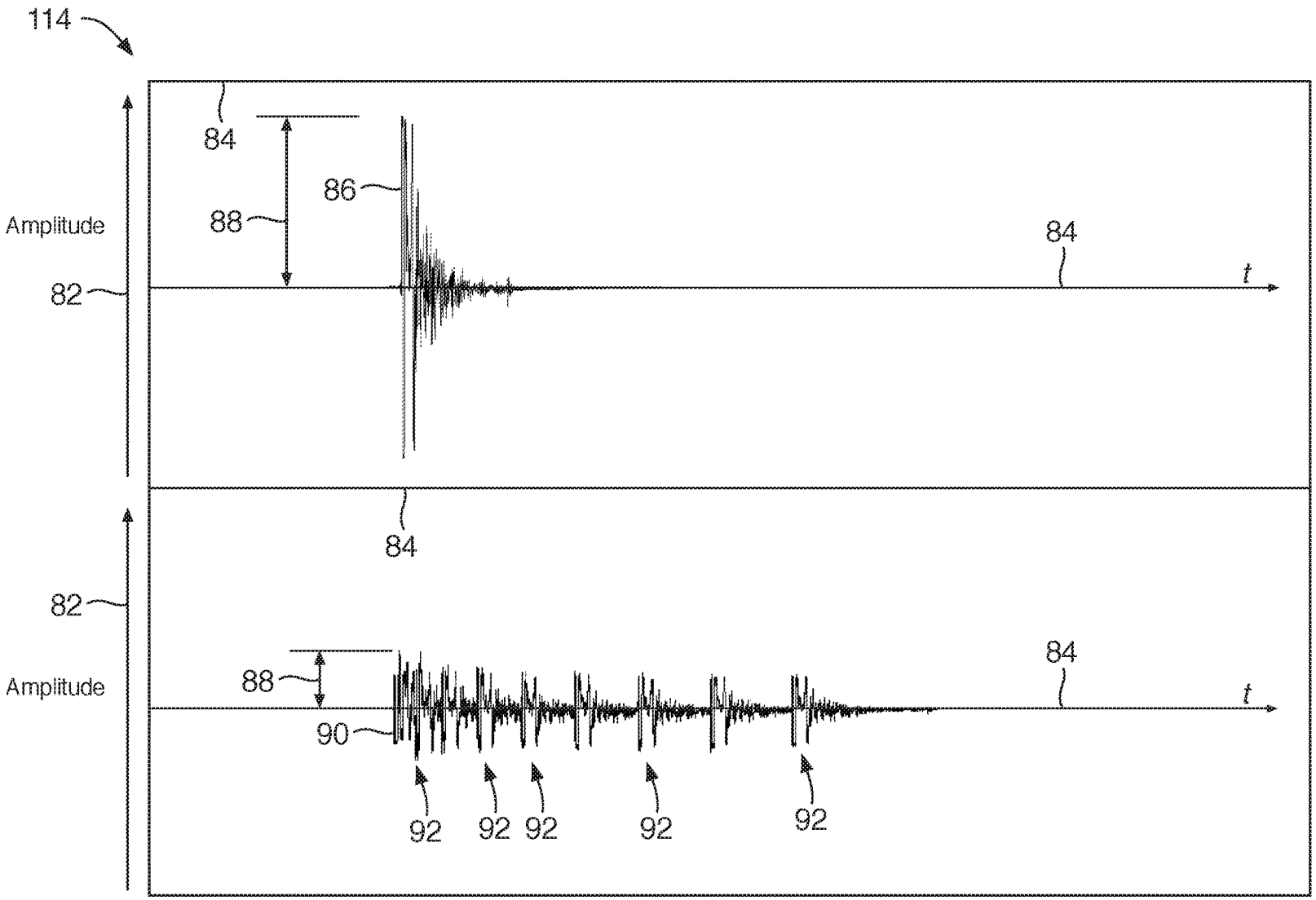
FIG. 13A is a chart comparing a single pulse or single cycle of a singular waveform imposed from a single event of gas generation, compared with an output waveform characterized by a repetition of the input waveform artifacts, but at a much reduced amplitude and maximum amplitude as a result of offsetting each in time to be presented to a terminal plenum or the environment at a different time, thus serializing in time what would otherwise be simultaneously additive energy and amplitude of the characteristic sound waveform.
Figure 13B:
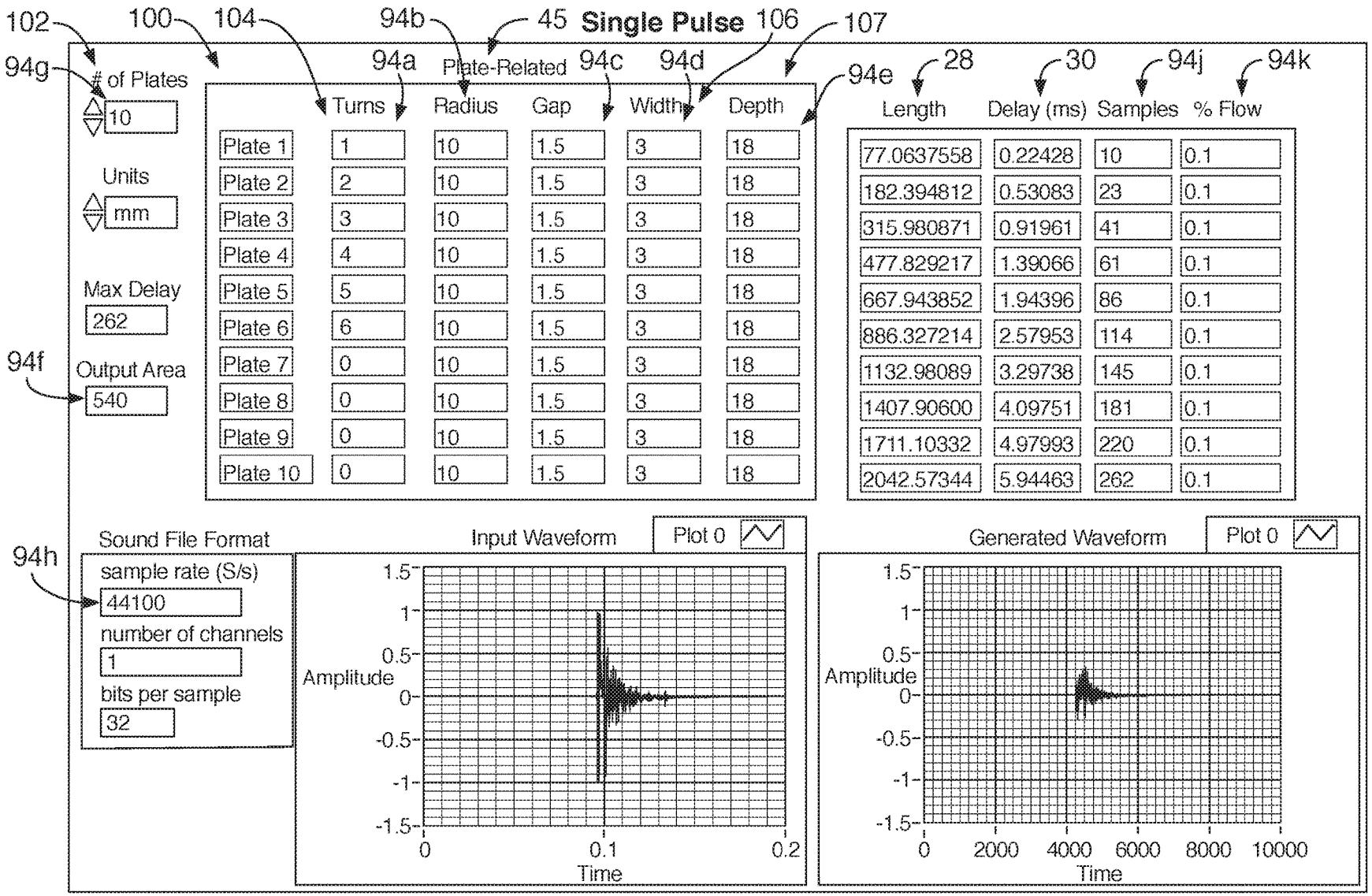
FIG. 13B is a chart of input data corresponding to the experimental output illustrated in FIG. 13A.

Referring to FIG. 13B, one will see that ten plates were used and the distances are measured in millimeters in this case. Total output area is 0.625 square inches. The widths and depths of the various channels 20 are identical for each plate. Individual lengths 28 shown result in the corresponding transit times 30 or delays 30 offsetting arrival of sound from each path 20. A data rate of 44,100 samples per second at 32-bit precision was used.

The present invention may be embodied in other specific forms without departing from its purposes, functions, structures, or operational characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A method of reducing an amplitude of sound released into an environment surrounding an event, the method comprising:

passing sound waves, corresponding to and generated by a single, individual event, occurring at a first location and capable of repetition, the sound waves traveling at the speed of sound and characterized by an amplitude having a first value as a function of time and a first maximum characteristic of the event, into a manifold;

sending the sound waves from the manifold through a plurality of paths, each path characterized by a length unique to that path, a path maximum amplitude in each path corresponding to but less than the first maximum, and selected based on subdividing among the plurality of paths energy in the sound waves corresponding to the event, independent from frequency of the sound waves, between the manifold and an exit releasing the sound waves into the environment therearound;

reducing the amplitude to a second value as a function of time and a second maximum, lower than the first value and first maximum, respectively, at the releasing the path maximum amplitude of the sound waves travelling along each path at a corresponding, distinct, and different time of arrival at the exit, based on each corresponding path length.

2. The method of claim 1, comprising:

providing a source of the sound waves; and connecting the source to the manifold.

3. The method of claim 2, wherein the source provides a flow of a gas through the paths.

4. The method of claim 3, wherein the paths constitute channels effectively sealed away from one another to resist fluid communication therebetween.

5. The method of claim 4, wherein the channels are mechanically effective to resist sound propagation therebetween.

6. The method of claim 5, wherein the channels are separated by walls, formed of a solid material, having a second speed of sound therethrough differing from a first speed of sound through the gas.

7. The method of claim 6, wherein the paths are shaped as at least one of arcuate, linear, and a combination thereof.

8. The method of claim 1, wherein the paths are characterized by lengths and exits corresponding thereto, the lengths differing sufficiently to displace in time from one another arrivals of the path maxima, based on the number of paths.

9. The method of claim 1, comprising selecting a number of the paths based on a desired reduction in the second value with respect to the second value.

10. The method of claim 1, wherein the number of the paths is selected to be inversely proportional to the ratio of the second maximum to the first maximum.

11. An apparatus comprising:

a manifold capable of connecting to a source producing single event capable of repetition and generating a flow of gas, traveling at flow speed, and a waveform, traveling at the speed of sound, comprising sound waves therein, characterized by an amplitude having a first value as a function of time and first maximum value thereof, corresponding to the event, passing through the gas;

channels operably connected to receive, at respective first ends thereof, the sound waveform from the manifold, subdivide the energy corresponding to the sound waveform generated by the event among the channels, and conduct resulting, respective, individual subdivided portions of the energy of the sound waves to second ends of the channels;

a terminus distal from the manifold and capable of returning the subdivided portions each at a respective, unique time to an environment;

the channels, each characterized by a length selected based on a unique transit time corresponding thereto and less than a time between repetitions of the event; and the terminus, operably capable of releasing the sound waves to the environment at a second value of amplitude as a function of time, less than the first value as a consequence of differences between transit times and consequent separation of arrivals of respective maximum sound amplitudes through the channels.

12. The apparatus of claim 11, wherein the channels are all characterized by a common cross-sectional area.

13. The apparatus of claim 12, wherein the cross-sectional area is configured in a common shape among all the channels.

14. The apparatus of claim 11, wherein individual envelopes corresponding to the channels are arrayed to interleave within one another.

15. The apparatus of claim 14, wherein an end-to-end shape of the channels is selected from arcuate, linear, and a combination thereof.

16. The apparatus of claim 15, wherein the arcuate shape includes at least one full 360 degree traverse by at least one of the channels between the manifold and the terminus.

17. The apparatus of claim 11, wherein the channels are all formed within a spatial envelope selected based on space available proximate the source.

18. The apparatus of claim 17 wherein the spatial envelope is shaped as at least one of a circular cylinder, an elliptical cylinder, a flat and planar shape having a thickness an order of magnitude less than one of a width and length thereof, a parallelepiped, a wrapped bundle of layers, and a combination thereof.

19. A method comprising:

providing a manifold operably connected to a first end of each channel of a plurality of channels, a second end of each constituting an exit to the environment, wherein the manifold is capable of connecting to a source producing a single event generating a flow of gas, traveling at a gas velocity, and a waveform, traveling at the speed of sound, comprising sound waves and an artifact therein, characterized by an amplitude having a first value as a function of time and first maximum value corresponding to the event, passing through the gas at the speed of sound, while the channels are operably connected to receive the flow and waveform from the manifold and conduct them to the environment at a second, reduced, value of maximum amplitude corresponding to the artifact, as a consequence of differences between transit times of the sound waves corresponding to the artifact through the channels;

connecting the manifold to the source;

subdividing amplitude and energy of the waveform by passing the waveform from the manifold into the channels;

delaying arrival times of the waveform through each channel based on a corresponding length and transit time unique to each channel;

reducing a maximum amplitude corresponding to the artifact, based on displacement in time of the transit times from one another of the sound waves corresponding to an artifact maximum amplitude emanating from each channel and corresponding in shape and duration to the artifact and maximum amplitude of the waveform at the event.

20. The method of claim 19, wherein:

the amplitude at the terminus is characterized by a second maximum value less than the first maximum value, the ratio thereof being proportional to the number of channels selected;

the channels are all characterized by a common cross-sectional area in a common, arcuate shape and nested within one another, formed within a spatial envelope selected based on space available proximate the source.

* * * * *